US009617798B2

(12) United States Patent
Roussie

(10) Patent No.: US 9,617,798 B2
(45) Date of Patent: Apr. 11, 2017

(54) TUBULAR DRILL STEM COMPONENT AND METHOD FOR TENSIONING A COMMUNICATION TUBE MOUNTED IN SAID COMPONENT

(71) Applicant: VALLOUREC DRILLING PRODUCTS FRANCE, Cosne Cours sur Loire (FR)

(72) Inventor: Gabriel Roussie, Valenciennes (FR)

(73) Assignee: VALLOUREC DRILLING PRODUCTS FRANCE, Cosne Cours sur Loire (FR)

( * ) Notice: Subject to any disclaimer, the term of this patent is extended or adjusted under 35 U.S.C. 154(b) by 392 days.

(21) Appl. No.: 14/350,250

(22) PCT Filed: Oct. 4, 2012

(86) PCT No.: PCT/EP2012/004151
§ 371 (c)(1),
(2) Date: Apr. 7, 2014

(87) PCT Pub. No.: WO2013/056790
PCT Pub. Date: Apr. 25, 2013

(65) Prior Publication Data

US 2014/0238750 A1 Aug. 28, 2014

Related U.S. Application Data

(60) Provisional application No. 61/563,056, filed on Nov. 23, 2011.

(30) Foreign Application Priority Data

Oct. 17, 2011 (FR) ..... 11 03168

(51) Int. Cl.
*E21B 17/02* (2006.01)
*E21B 17/00* (2006.01)

(52) U.S. Cl.
CPC ..... *E21B 17/02* (2013.01); *E21B 17/003* (2013.01); *E21B 17/028* (2013.01)

(58) Field of Classification Search
CPC ..... E21B 17/02; E21B 17/028; E21B 17/003
See application file for complete search history.

(56) References Cited

U.S. PATENT DOCUMENTS 3,829,816 A 8/1974 Barry et al.
6,641,434 B2 11/2003 Boyle et al.
(Continued)

OTHER PUBLICATIONS

International Search Report issued Nov. 5, 2012 in PCT/EP12/04151 filed Oct. 4, 2012.

*Primary Examiner* — Brad Harcourt
(74) *Attorney, Agent, or Firm* — Oblon, McClelland, Maier & Neustadt, L.L.P.

(57) ABSTRACT

A tubular component for a drill stem, for drilling a hole, the component including a first end section including a first threading, a second end section including a second threading, and a substantially tubular central section, a hole being provided in at least one of the first and second end sections, and a tensioner for a communications tube disposed in the hole, the tensioner operating by deformation of a regular section of the communications tube, the tensioner being disposed in a housing provided in at least the section, at a distance from the ends of the communications tube, the housing intersecting with the hole.

27 Claims, 13 Drawing Sheets

(56) References Cited

U.S. PATENT DOCUMENTS

| | | | | |
|---|---|---|---|---|
| 7,852,232 | B2 * | 12/2010 | Hall | E21B 17/003 285/333 |
| 2004/0244964 | A1 | 12/2004 | Hall et al. | |
| 2005/0001736 | A1 * | 1/2005 | Hall | E21B 17/023 340/854.1 |

* cited by examiner

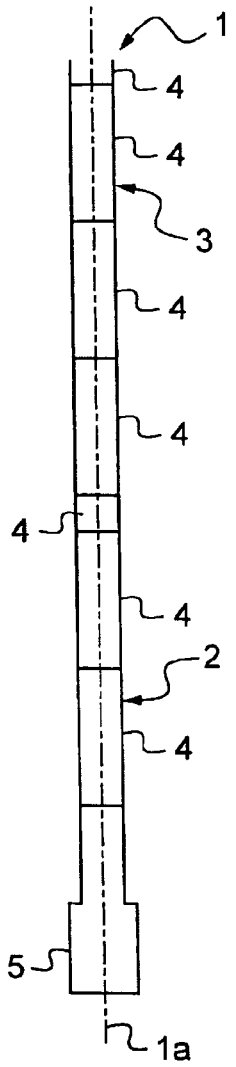
Fig.1a
Fig.1b
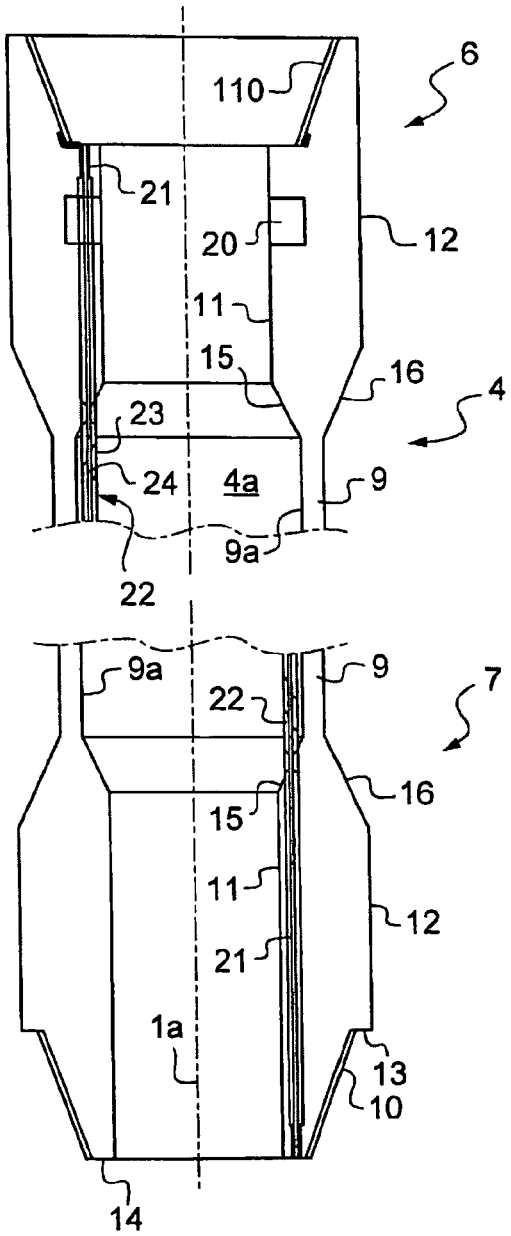

22
26
12
7
15
8
16
13
10
27
25
31
27a
27b
4
20
21
11

33b
33
33a
34a
30
40
32
38
26
23
28
24
22
39
26f
37
27b
25
27
29
26a
31

33b
33
33a
34a
40
30
32
28
26
23
24
22
38
26f
37
27b
25
27
29
26a
39
31

Fig.4
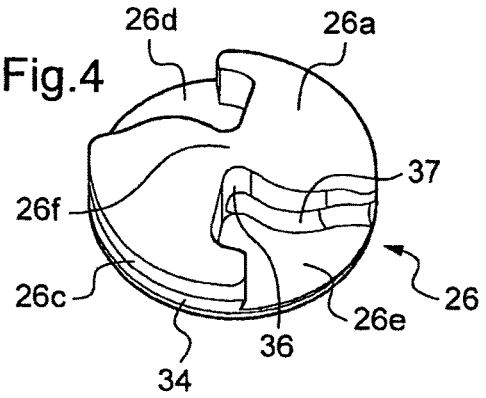
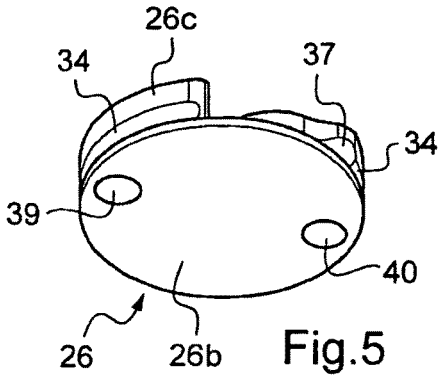
Fig.5
Fig.6
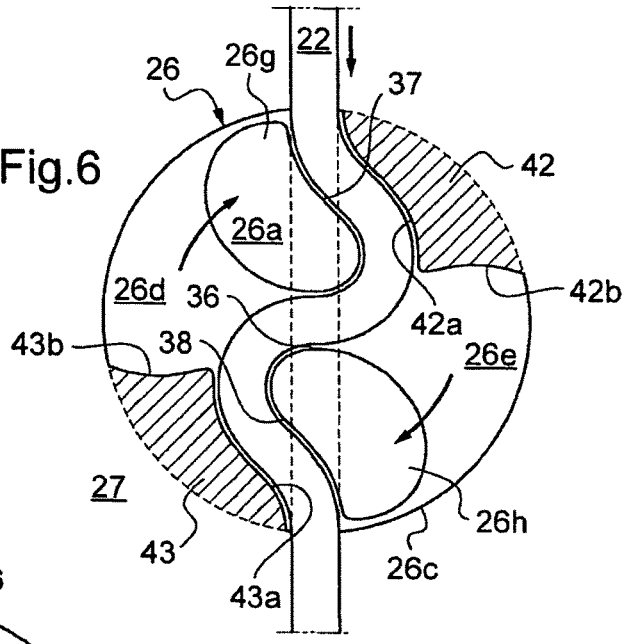
Fig.7
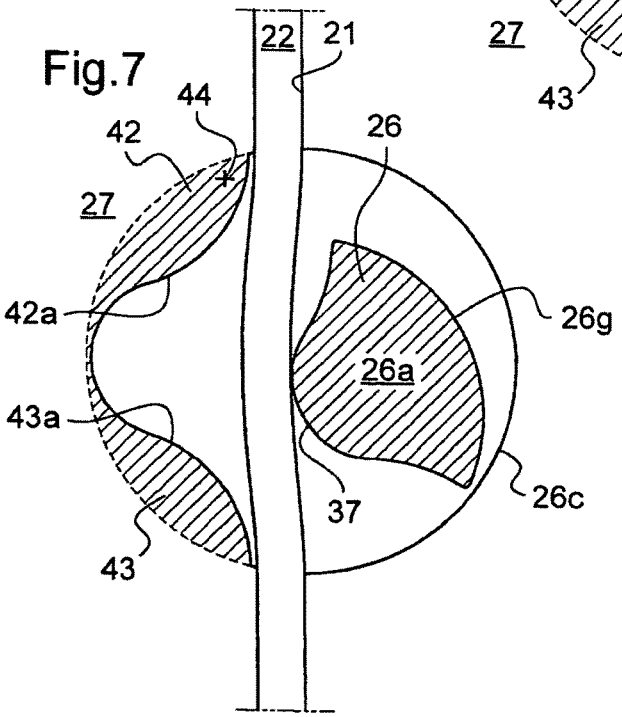

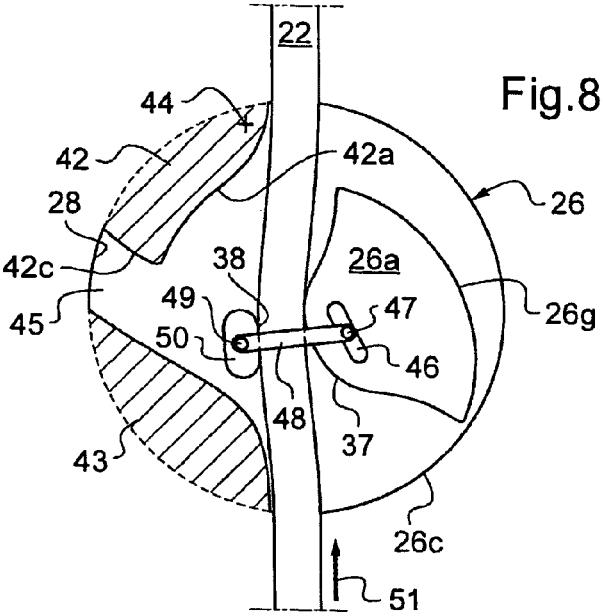
Fig.8
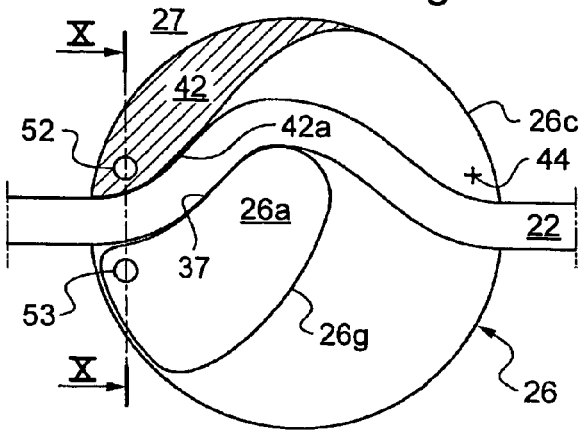
Fig.9
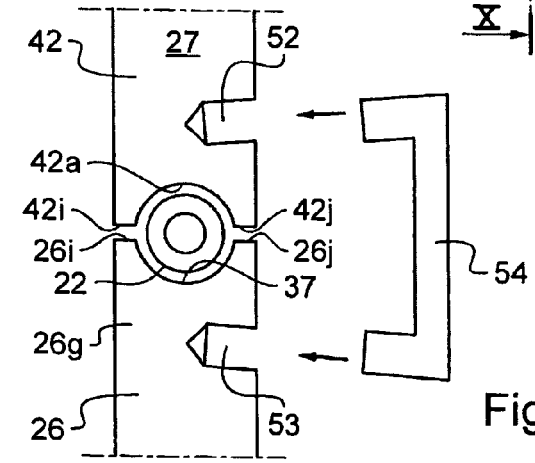
Fig.10
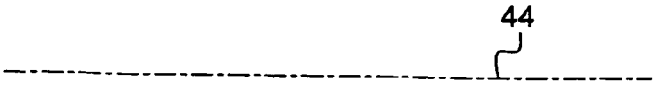

Fig.13
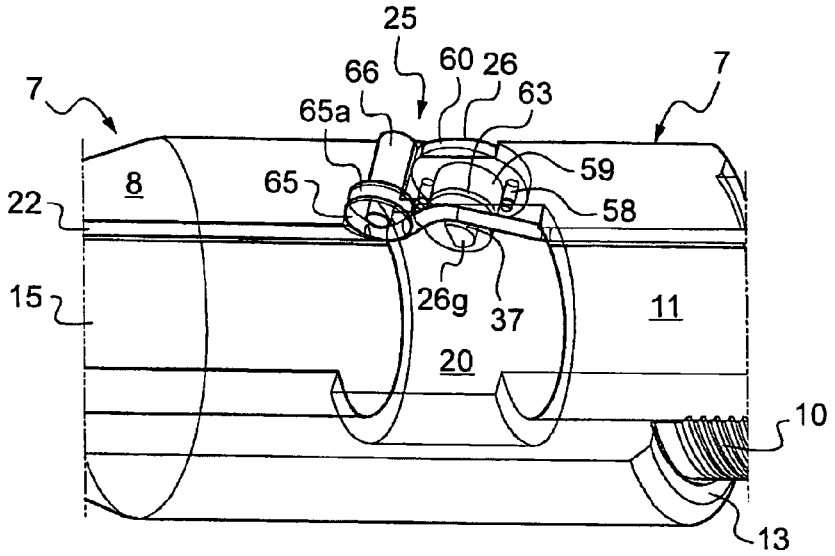
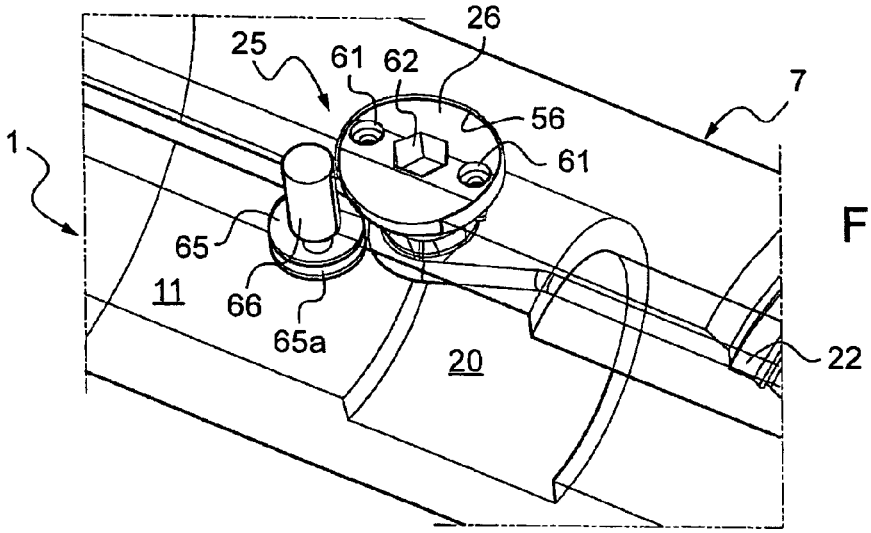
Fig.14
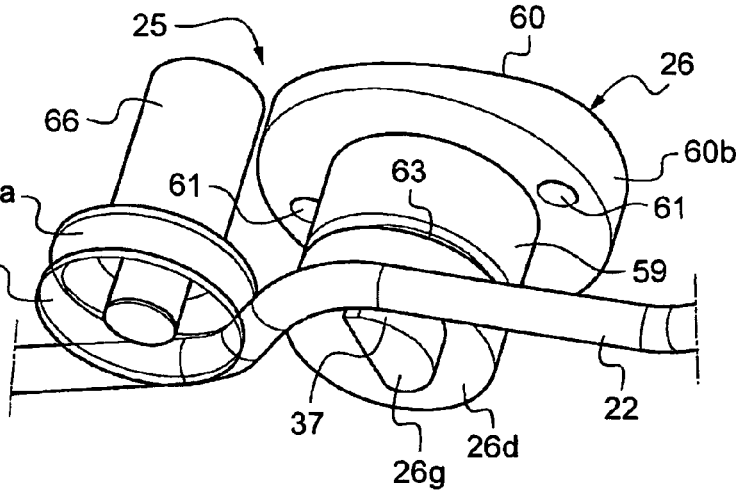
Fig.15

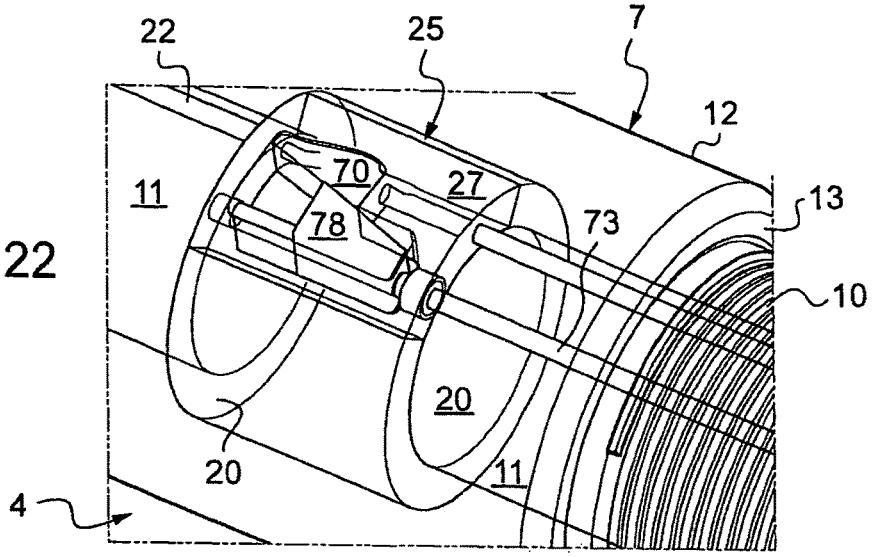
Fig.22
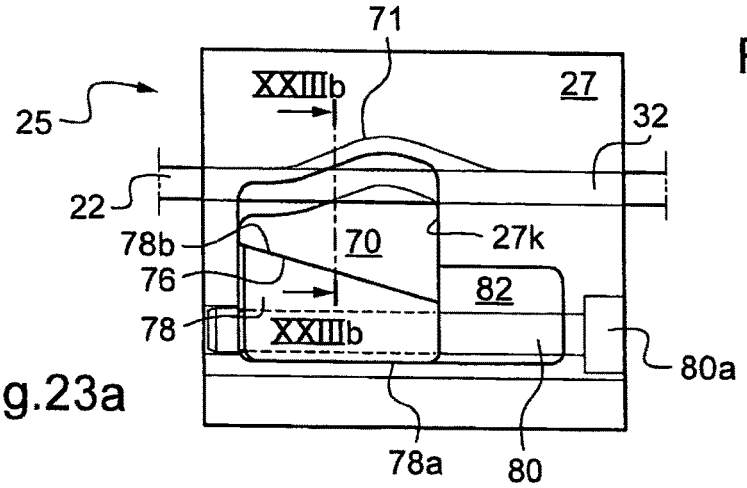
Fig.23a
Fig.23b
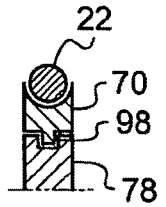
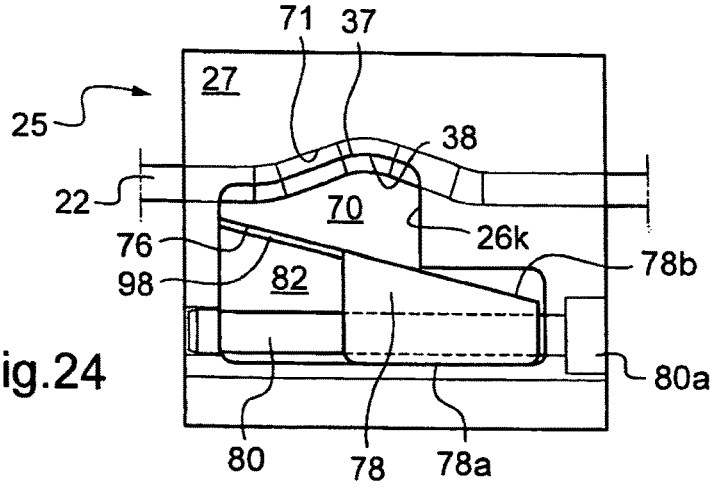
Fig.24

Fig.25
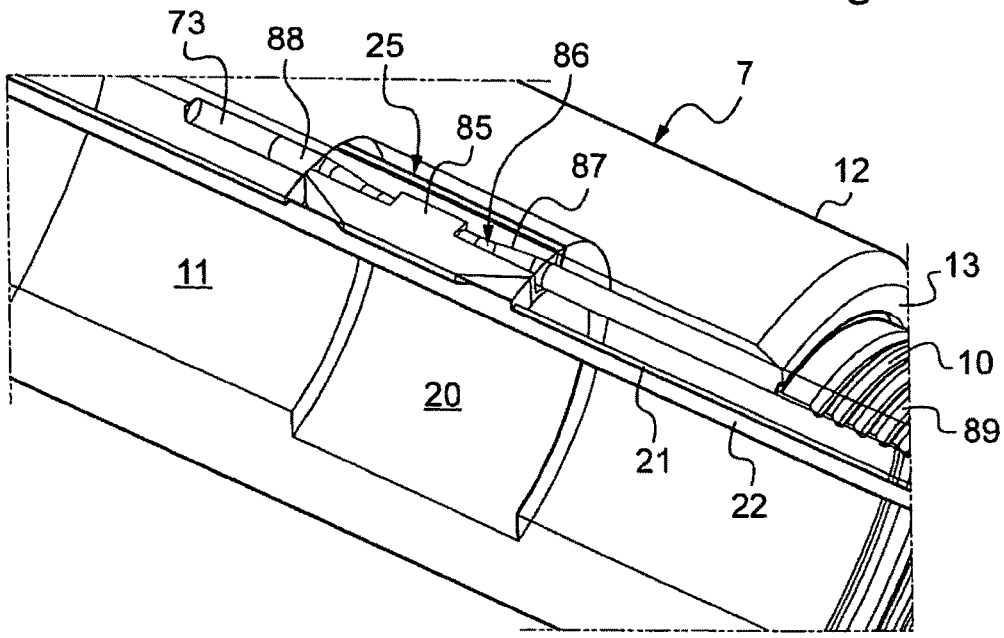
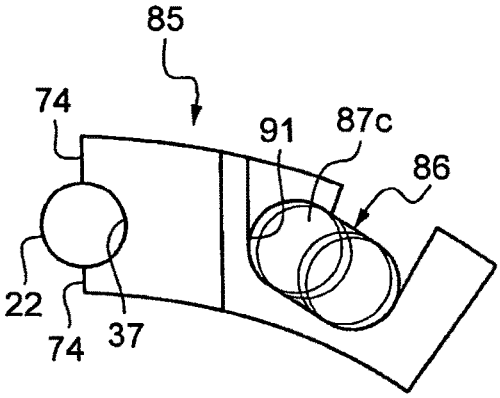
Fig.26
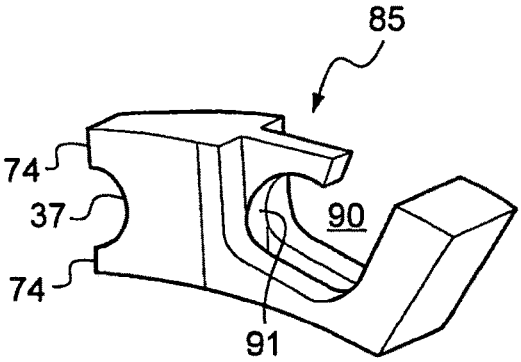
Fig.27

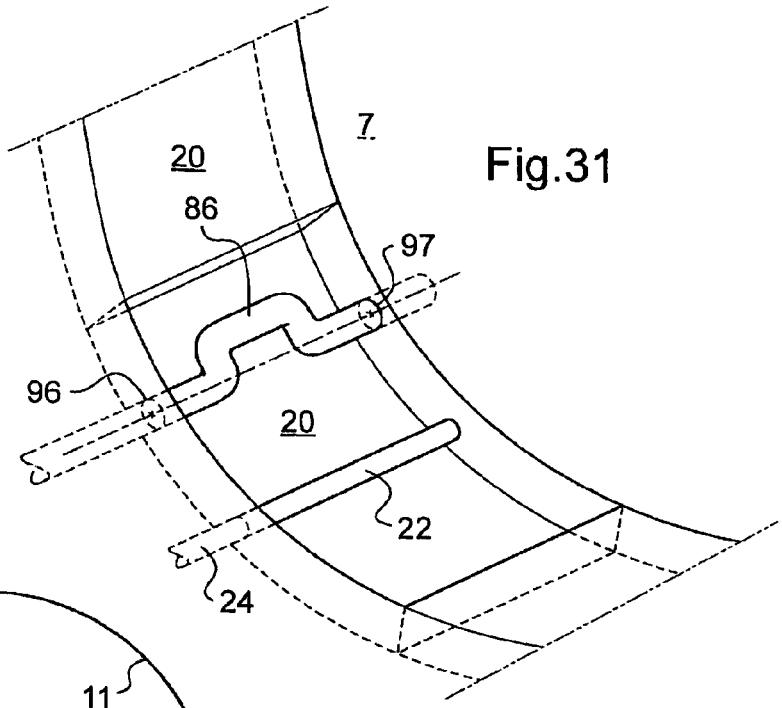
Fig.31
Fig.32
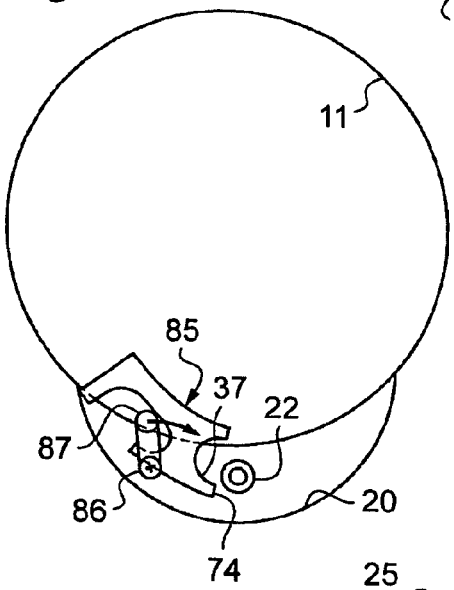
Fig.33
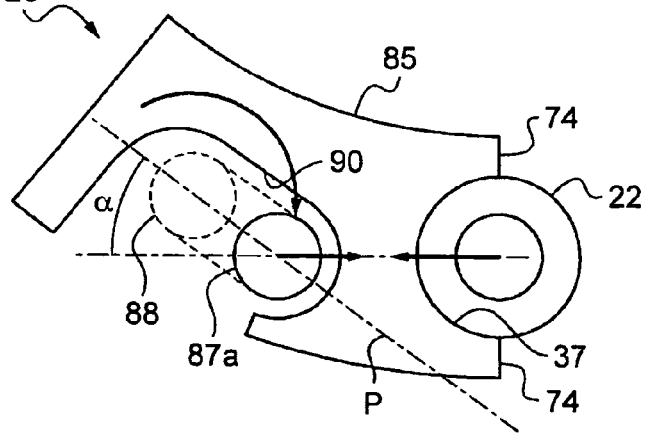

TUBULAR DRILL STEM COMPONENT AND METHOD FOR TENSIONING A COMMUNICATION TUBE MOUNTED IN SAID COMPONENT

The invention relates to the field of exploration and operation of oil or gas fields in which rotary drillpipe strings are used which are constituted by tubular components such as standard and possibly heavy weight drill pipes and other tubular elements, in particular drill collars at the bottom hole assembly, connected end to end as a function of drilling needs.

More particularly, the invention relates to a profiled element for rotary or non-rotary drilling equipment such as a pipe or a heavy weight pipe, disposed in the body of a drillpipe string.

Such stems can in particular be used to produce deviated holes, i.e. holes the inclination of which with respect to the vertical or the horizontal direction can be varied during drilling. Deviated holes can currently reach depths of the order of 2 to 6 km and horizontal displacements of the order of 2 to 14 km.

In the case of deviated holes of that type, comprising practically horizontal sections, the frictional torques due to rotation of the drillpipe string in the well may reach very high values during drilling. The frictional torques may compromise equipment used or drilling targets. Furthermore, raising the debris produced by drilling is very often difficult because of sedimentation of the debris produced in the drilled hole, in particular in the portion of the drilled hole which is steeply inclined to the vertical. The mechanical stress on the tubular components is increased in this manner.

In order to provide a better understanding of the events occurring at the hole bottom, close to the bit, bottom hole assemblies may be provided with measuring instruments. The measured data has to be communicated to the surface in order to be processed. Data transfer is generally ensured by means of a communications tube comprising a communications cable. The tube is disposed in a drill pipe, in the bore in the regular section and in a hole provided in the thickness of the wall at the ends. However, the communications tube might vibrate or become displaced, giving rise to risks of premature breakage.

The invention will improve the situation. The tubular component of the drill stem is configured to drill a hole. The component comprises a first end section comprising a first threading, a second end section comprising a second threading and a central, substantially tubular section. The first threading may be a female threading. The second threading may be a male threading. A hole is provided in at least one of the first and second sections. The component comprises a tensioner for a communications tube disposed in the hole. The tensioner operates by plastic deformation such that at least a regular section of the communications tube is modified. The tensioner is disposed in a housing provided in at least said section, at a distance from the ends of the communications tube. The housing and the hole intersect. Thus, the communications tube can be placed under tension by deformation beyond the elasticity of the deformed portion. The remainder of the communications tube is tensed within the elastic domain. The plastic deformation means that the communications tube can be kept under permanent tension.

In one embodiment, the component comprises a communications tube. The communications tube is disposed at least in the central section and in the hole. The communications tube comprises two ends and a regular section projecting into the housing. The term "regular section" means any transversal section of the tube, the regular section being located between the ends of said tube; the regular section being defined transversally relative to the longitudinal axis of the tubular component. Such regular section is locally modified where the tube is plastically deformed. On the other hand, an internal section defined transversally to the neutral axis of the tube is preferably of a substantially constant cross section, also where the tube is plastically deformed. At least one end of the communications tube is attached to the end section of the corresponding component. Attachment may be accomplished by beading, punching, bonding, brazing, welding, etc, or by using a tensioner of the invention.

In one embodiment, the communications tube has at least two inversions of curvature granted by the tensioner, especially over a portion of the tube with a length of less than 100 mm. The bent portions of the communications tube resulting from the inversions of curvature participate in locking the communications tube in the axially tensed position.

In one embodiment, the communications tube has a radius of curvature of more than 100 mm. Excessive twisting of the communications tube is avoided, meaning in particular that its inner cross-section can be retained along with the integrity of the cable or cables passing through the communications tube.

In one embodiment, the hole is substantially parallel to a longitudinal axis of the component. The hole is provided in an end section with a thickness which is greater than the thickness of the central section.

In one embodiment, the tensioner comprises a swivel. The communications tube passes through the swivel in the insertion position and in the service position. The communications tube is inserted in the swivel in order to move into the insertion position.

In one embodiment, the swivel comprises at least one cam leaving a free passage for a straight communications tube in an insertion position and leaving an undulating passage for a communications tube in a service position of the swivel. The swivel comprises a bearing surface to force rotation of said swivel from the insertion position into the service position. Rotation of the swivel plastically deforms the communications tube.

In one embodiment, the tensioner comprises a mount fixed in the housing. The mount receives the swivel. The swivel is received in the housing in contact with said end. The tensioner comprises a mechanism which limits rotation of the swivel. Excessive deformation of the communications tube is prevented. The limiter mechanism comprises a finger urged in translation by a spring. The finger and the spring are housed in a blind hole of the component. The finger interferes with the swivel. The finger projects into a groove provided on a circumferential face of the swivel. The finger is configured to interfere in the service position with an anti-return abutment. Rotation of the swivel in the opposite direction towards the insertion position is prevented. Depending on the embodiments, the limiter mechanism comprises a screw, a ratchet or a clip.

In one embodiment, said bearing surface is formed by at least one hole provided in the swivel from a radial surface. An operator may engage therein a tool to turn the swivel.

In one embodiment, the component comprises a rod to hold the swivel translationally. The rod is substantially parallel to the axis of the communications tube. The rod participates in retaining the swivel in the housing while allowing rotation of said swivel.

In one embodiment, the component comprises a first cam forming part of the swivel and a second cam articulated with respect to the swivel. The articulation comprises two stays. The stays may be parallel. The stays may be pivotably mounted on the swivel. The second cam may be pivotably mounted on the stays.

In one embodiment, the component comprises a first cam for locking the position of the communications tube and a second cam to deform the communications tube. The risk of the communications tube sliding during rotation of the swivel is reduced.

In one embodiment, the component comprises a roller to stop the communications tube from jamming. The roller comprises a grooved wheel in contact with the communications tube. Deterioration of the communications tube on the side of the swivel directed towards the other end section, in particular by friction on the side of the hole opening into the housing, is prevented.

In one embodiment, the hole provided in at least one of the first and second ends has a flared surface linking to the housing.

In another embodiment, the tensioner comprises at least one jaw through which the communications tube passes. The jaw comprises at least one cam leaving a passage free for the straight communications tube in an insertion position and leaving an undulating passage for the communications tube in a service position of the jaw. At least one jaw comprises a bearing surface to force tightening of the jaw from the insertion position into the service position. The tensioner comprises a member for tightening the jaw. The tightening member is inactive or not tightened in the insertion position and active or tightened in the service position.

In one embodiment, the jaw tightening member can be actuated from the frontal surface of said end. The tightening member comprises a screw or a pointed rod housed in a hole provided in the thickness of the end section. The jaw may be disposed substantially concentrically with the component; the housing is annular.

In one embodiment, the tightening member comprises two axially positioned slides controlled by a screw substantially parallel to the axis of the component. Each slide comprises two sliding surfaces which are inclined with respect to the axis of the component. Each sliding surface of a slide has an inclination which is opposite to the other sliding surface of said slide and has an opposite inclination to the corresponding sliding surface of the other slide. On the side opposite to the communications tube, each jaw comprises bearing surfaces in contact with the sliding surfaces of the slides, the bearing surfaces of a jaw joining up in the middle of the jaw in the axial direction. Such V-shaped or inverted V-shaped surfaces can transform an axial translational movement of the sliding surfaces into a translational movement of the bearing surfaces in the perpendicular direction. Said translation of the bearing surfaces, in cooperation with the bore of the housing, causes the jaws to pivot about the axis of the housing.

In one embodiment, one jaw is fixed and the other jaw is movable under the action of the tightening member. The fixed jaw forms part of a mount disposed in the housing. The movable jaw may be pivotably mounted with respect to the mount. The movable jaw may be mounted for translation with respect to the mount. The movable jaw may be in contact with an axial abutment surface of the mount.

In one embodiment, the tightening member comprises an axially positioned slide controlled by a screw. The screw may be parallel to the axis of the component, the slide may be mounted for translation between a bearing surface of the movable jaw and a reaction surface of the mount. In one embodiment, the jaw comprises a snap-fitting mechanism with a stable position in the service position. The jaw is housed in the housing in the service position. The jaw projects with respect to the housing in the insertion position. Displacement of the jaw from the insertion position to the service position may be carried out by pushing the jaw radially outwardly. The jaw may be articulated on an actuating eccentric, the jaw being fixed in the housing, in particular as regards translation. The actuating eccentric of the snap-fitting mechanism may include a crank.

In one embodiment, the component comprises two movable jaws. The tightening member comprises rods which can be actuated from a frontal surface of the component. The actuation may be translational.

In one embodiment, the tightening member comprises a crank interacting with a movable jaw. Said crank is stable in the service position. Actuation may be carried out via the crank. Actuation may be carried out via the jaw projecting into the bore of the end section in the insertion position. The housing may be concave in shape, occupying an angular sector of less than 180° with respect to the axis of the component.

The method for tensioning a communications tube mounted in a tubular component of a drill stem, extending at least in a central section and in a hole provided in at least one section of the component, comprises mounting a communications tube tensioner in a housing provided in at least one section of the component, at a distance from the ends of the communications tube, and actuating the tensioner, causing plastic deformation of the communications tube.

The tensioner may comprise a cam surface. The cam surface is in contact with a portion of the communications tube. The cam surface may be displaced in a circumferential direction with respect to the axis of the component.

The tensioner holds the communications tube with respect to the tubular component. The plastic deformation provides considerable retention, especially compared with retention by friction, with or without elastic deformation of the tube. Plastic deformation produces permanent tension. The tensioner places a remaining portion of the communications tube under tension, especially a portion included between the tensioner and a distant end of the communications tube. The tensioner limits the return of the remaining portion to an initial, substantially non-tensed situation. Said distant end may be fixed to the end section of the component opposite to the end section in which the tensioner is disposed. The housing for the tensioner may be provided from a bore of the end section.

A number of variations are possible for the tubular component; at least some of their characteristics may be combined with each other.

Further characteristics and advantages of the invention will become apparent from an examination of the detailed description below, and the accompanying drawings, in which:

FIGS. 1*a* and 1*b* are diagrammatic views of a drill stem and a tubular component;

FIG. 2 is a partial exploded perspective view of an end section of a tubular component or drill pipe in accordance with one embodiment;

FIGS. 3*a* and 3*b* are front views from above of a tensioner in accordance with FIG. 2, in various positions relative to the communications tube; FIG. 3*a* shows the tensioner in the service position and FIG. 3*b* shows the tensioner in a configuration before deformation of a communications tube;

FIGS. 4 and 5 are perspective views of a swivel of the tensioner of FIG. 2;

FIGS. 6 to 9 are partial sectional views, in a plane normal to an axis or rotation of the swivel, of tensioners in accordance with variations of FIG. 2;

FIG. 10 is a diagrammatic view of a locking clip for the tensioner of FIG. 9;

FIG. 13 is an exploded perspective view of an end section of a tubular component in accordance with another embodiment;

FIG. 14 is an analogous view to FIG. 13, from another viewing angle;

FIG. 15 is a detailed view of FIG. 13;

Figure 16:
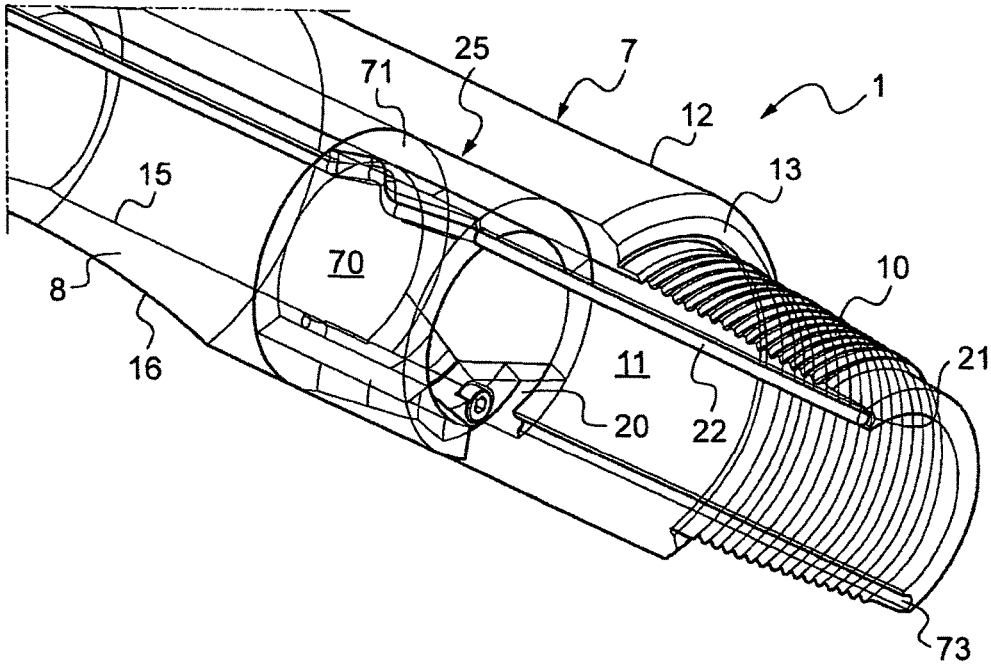
FIG. 16 is an exploded perspective view of a tensioner in accordance with another embodiment.
Figure 17A:
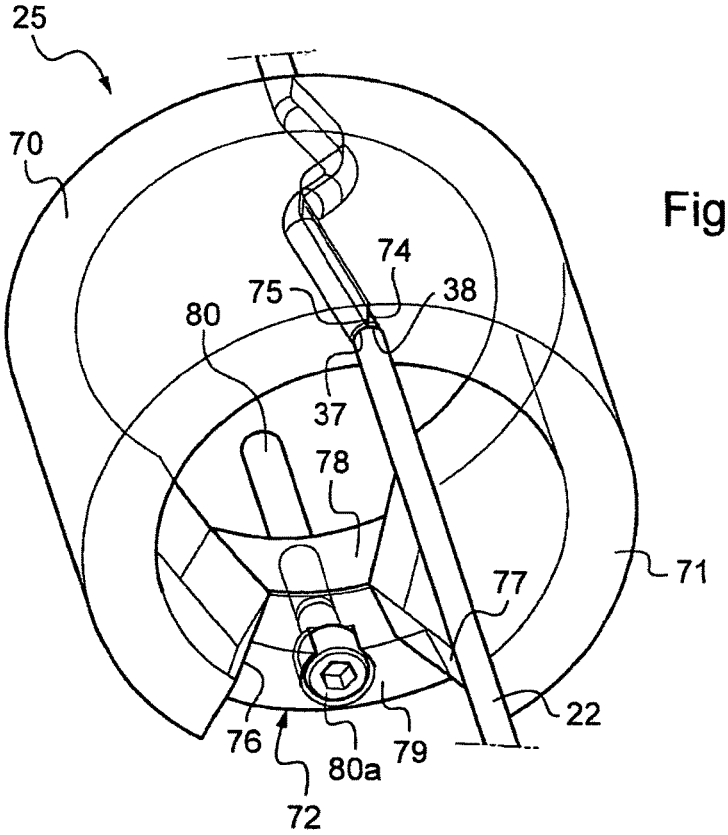
Figure 17B:
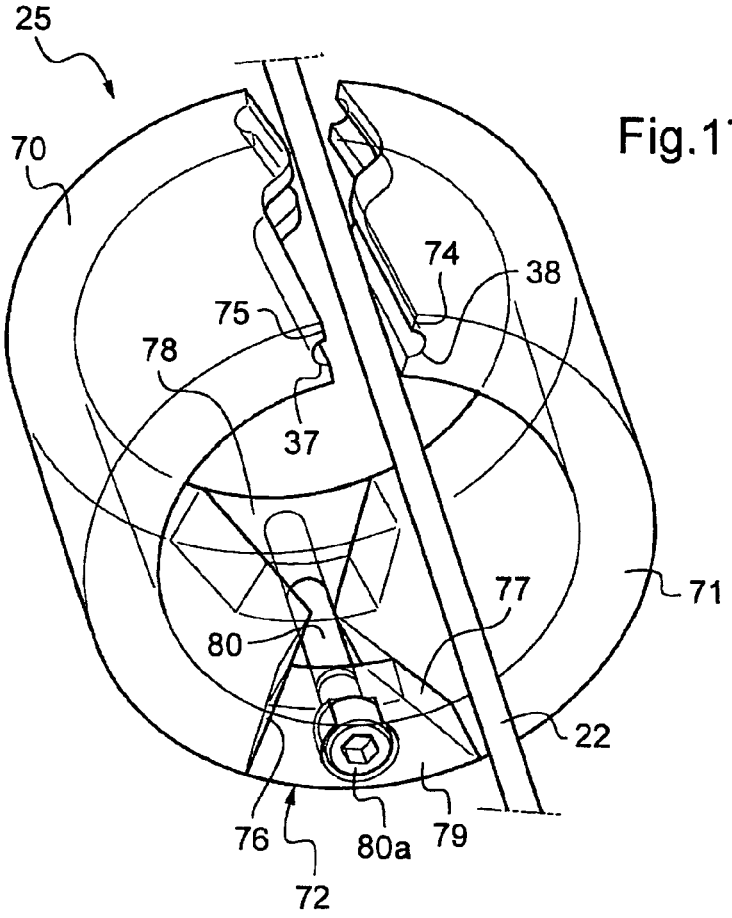
Figure 18:
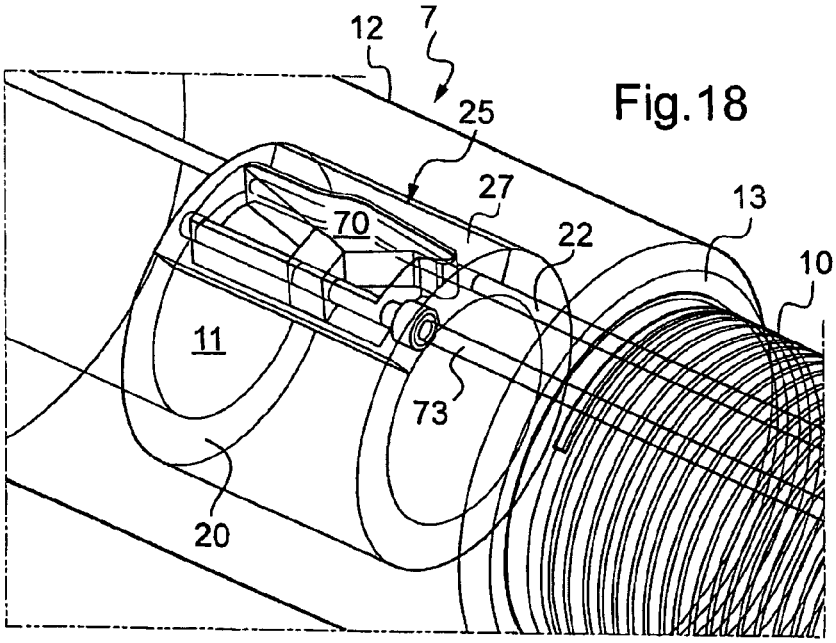
Figure 19:
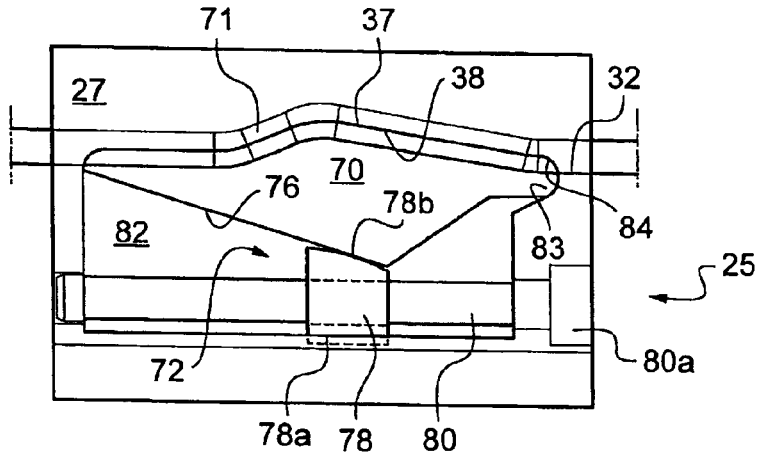
Figure 20:
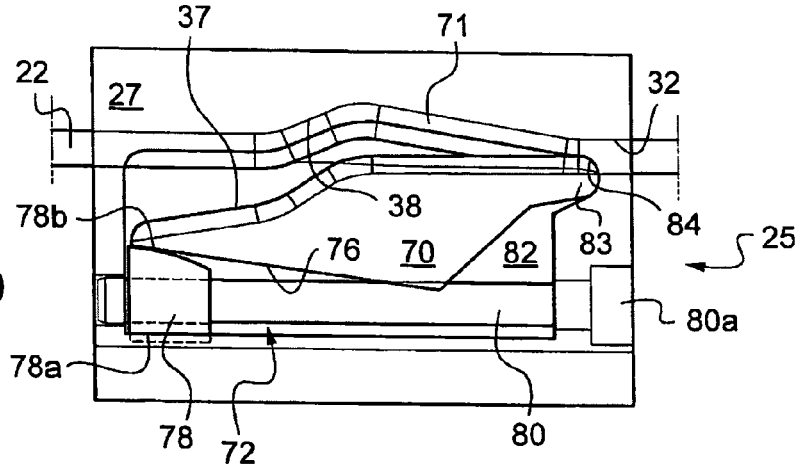
Figure 21:
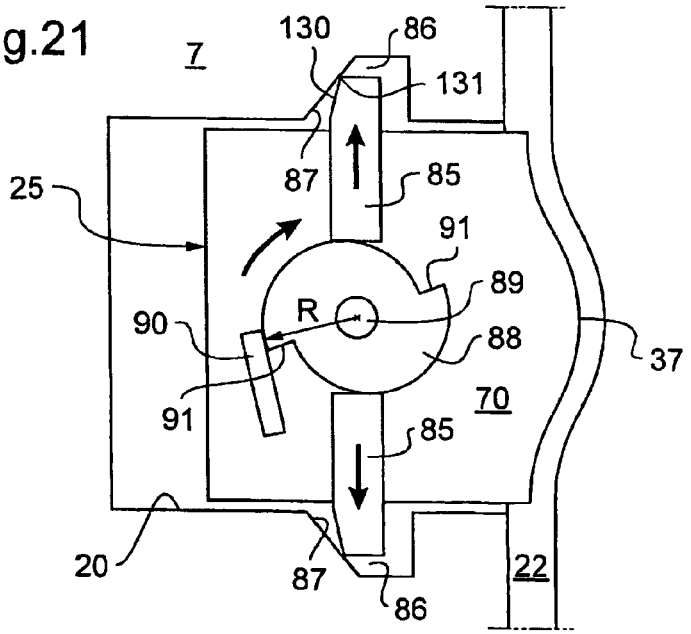

FIG. 17*a* is a detailed view of the tensioner of FIG. 16 in the service position;

FIG. 17*b* is a detailed view of the tensioner of FIG. 16, in a configuration before deformation of a communications tube;

FIG. 18 is an exploded perspective view of an end section of a tubular component in accordance with another embodiment;

FIG. 19 is a front view from above of the tensioner of FIG. 18;

FIG. 20 is a view analogous to FIG. 19, in another cam position;

FIG. 21 is a front view from above of a tensioner in accordance with another embodiment;

FIG. 22 is an exploded perspective view of an end section of a tubular component in accordance with another embodiment;

FIGS. 23*a* and 24 are front views from above of the tensioner of FIG. 22, in two distinct positions;

FIG. 23*b* is a detailed view along the sectional plane XIIIb-XIIIb indicated in FIG. 23*a;*

Figure 28:
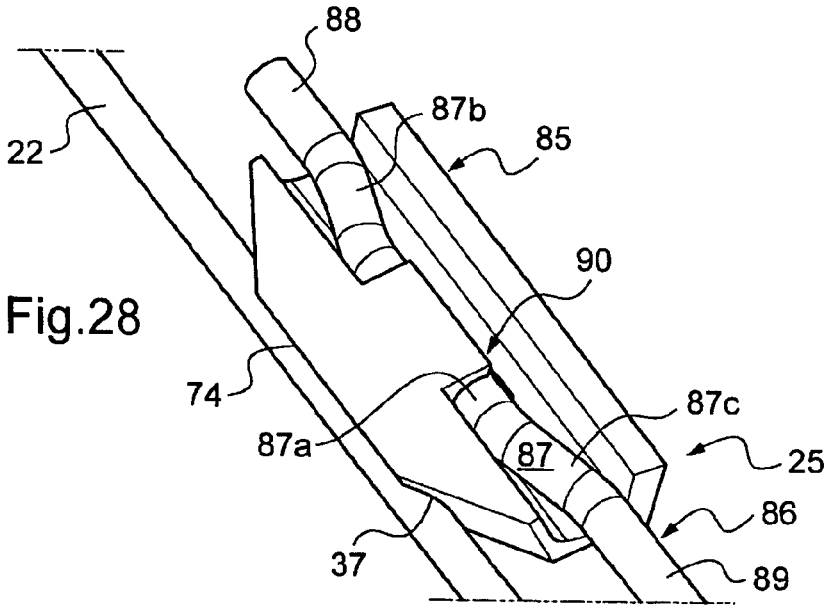
Figure 29:
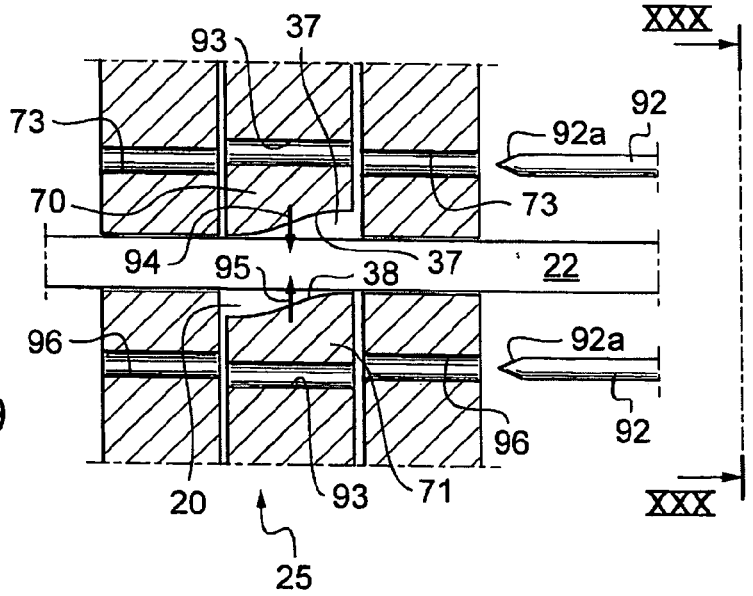
Figure 30:
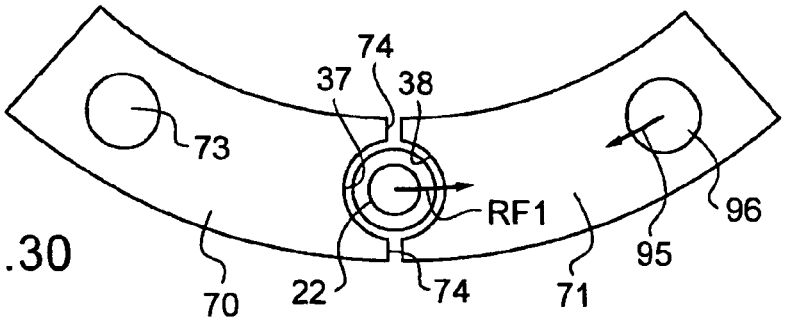

FIG. 25 is an exploded perspective view of an end section of a tubular component in accordance with another embodiment;

FIG. 26 is a detailed view in axial section of the tensioner of FIG. 25;

FIG. 27 is a detailed perspective view of the tensioner of FIG. 25;

FIG. 28 is a perspective view of a tensioner, a tubular component and a communications tube when assembled;

FIG. 29 is a front view from above of an end section of a tubular component in accordance with another embodiment;

FIG. 30 is a front view in elevation of a tensioner along the plane XXX-XXX indicated in FIG. 29;

FIG. 31 is an exploded perspective view of an end section of a tubular component in accordance with another embodiment;

FIG. 32 is an axial sectional view of the tensioner of FIG. 31 in the locked position; and FIG. 33 is an axial sectional view of the tensioner of FIG. 31 in a position intermediate between the insertion position and the service position.

The drawings contain elements of a concrete nature. Thus, they may not only serve to provide a better understanding of the present invention, but they may also, if necessary, contribute to its definition.

When excavating a well, a drill tower is disposed on the ground or on an offshore platform to drill a hole in the strata of the ground. A drill stem is suspended in the hole and comprises a drilling tool such as a drill bit at its lower end. The drill stem is driven in rotation by a drive mechanism which, for example, is hydraulic. The drill stem is suspended by a hook attached to a travelling block with a rotary head which allows rotation of the drill stem with respect to the hook. A drilling fluid or mud is stored in a reservoir. A mud pump sends drilling fluid into the drill stem via an orifice of the injection head, forcing the drilling fluid to flow downwards through the drill stem. The drilling fluid then leaves the drill stem via channels in the drill bit then rises in the generally annular space formed between the outside of the drill stem and the wall of the hole. The drilling fluid lubricates the drilling tool and brings the debris excavated by the drill bit from the bottom of the hole to the surface. The drilling fluid is then filtered so that it can be re-used. The bottom hole assembly may include a drill bit and drill collars the mass of which ensures that the drill bit bears against the hole bottom.

The bottom hole assembly may also comprise measurement sensors, for example for measuring pressure, temperature, stress, inclination, resistivity, etc. Signals from the sensors can be sent to the surface via a cabled telemetry system. A plurality of couplers, for example magnetic, may be interconnected inside the drill stem to form a communications link; see U.S. Pat. No. 6,641,434, for example. The communications link may be formed using other techniques providing a link between the components of the drill stem. The two ends of a drilling component are provided with communications couplers. The two couplers of the component are connected via a cable extending over substantially the length of the component. The cable is disposed in a protective tube, also termed the communications tube. The communications tube is generally inserted in a hole provided in the thickness of the walls of the end portions of the component. In a central zone of the component, the communications tube is disposed in a bore of said component because the wall of the central zone is integral with but thinner than the wall of the end portions.

The invention primarily aims to provide a tubular component of a drill stem that can allow transmission of data and/or energy in a reliable manner over time and over the length of the drill stem, while keeping the cross section of passage for the drilling mud high and allowing the component to be re-used. The communications tube, attachment of which with respect to the components of the drill stem is improved, exhibits less wear, especially under intense mechanical loads which are exerted on the drill stem, in particular traction, compression, torsion, or buckling, and under a variety of pressures, both internal and external, under a variety of temperatures and under vibrational loads.

The drill stem may comprise a plurality of components, in particular standard pipes obtained by assembling, by welding, a male end, a great length tube and a female end on the opposite side from the male end to form sealed tubular threaded connections, and possibly heavy weight pipes. A pipe may be one of several types in accordance with specification AP17 from the American Petroleum Institute or in accordance with the manufacturer's own designs.

The tubular component may be of the type described in the documents U.S. Pat. Nos. 6,670,880, 6,717,501, US 2005/0115717, US 2005/0092499, US 2006/0225926, FR 2 883 915 or FR 2 940 816.

The term "substantially" as used below accommodates the usual tolerances in the technique field under consideration.

In the example shown in FIG. 1*b*, a tubular component is considered which comprises a female end section, a male end section and a substantially tubular central section. The male section comprises a male threading provided on an external surface, for example substantially tapered. The male section also comprises a bore, an external surface, a shoulder, for example substantially radial, between the male threading and the external surface, and an end surface, for example substantially radial. The bore and the external surface may be cylindrical bodies of revolution and may be concentric. The male section is linked to the tubular body or central section via an internal substantially tapered surface and an external substantially tapered surface. The bore of the central section may have a diameter which is greater than the diameter of the bore of the male section and the female section. The external diameter of the central portion may be less than the diameter of the external face of the male section and the female section. The female section comprises internal surfaces which are complementary to the surfaces of the male section for the purposes of makeup with a complementary male section of another tubular component.

As can be seen in FIGS. 1*a* and 1*b*, the drill stem 1 is generally a body of revolution about an axis 1*a* which substantially constitutes the axis of the hole. The drill stem 1 comprises a bottom hole assembly 2 and a drill string 3 connecting the bottom hole assembly 2 to the surface. The bottom hole assembly 2 comprises tubular components 4, in particular heavy weight pipes. The drill string 3 comprises tubular components 4, in particular pipes. The drill stem 1 is in the service position inside a drilled hole produced by a tool such as a drill bit 5 disposed at the lower end of the bottom hole assembly 2. The axis 1*a* is the axis of rotation of the drill string. The tubular components have a tubular shape with a central channel 4*a* which is a body of revolution.

The components of the drill stem, in particular the drill pipes forming a drill string, are produced in a tubular shape and are connected together end to end, such that their central channels 4*a* are in the extension of each other and constitute a continuous central space for movement of a drilling fluid from top to bottom, between the surface from which drilling is carried out to the hole bottom where the drilling tool is operating.

The drilling fluid or mud then rises in an annular space defined between the wall of the drilled hole and the external surface of the drill string. A drill stem may comprise pipes, heavy weight pipes, drill collars, stabilizers or other connections. Unless otherwise stated, the term "drill pipe" or tubular component as used here denotes both drill pipes and heavy weight drill pipes generally located between the drill pipe string and the bottom hole assembly. The tubular components are assembled end to end by makeup into a drill string which constitutes a large proportion of the length of the drill stem.

The tubular component 4 may be produced from high strength steel from a single original part, or it may be produced in sections then welded together. The tubular component 4 may comprise profiled end sections 6 and 7 which are relatively short, for example less than one metre in length, forming a connector for connecting the pipes, and a tubular central section 8 with a length which may exceed 10 meters, welded together. The central section 8 may have an external diameter which is smaller than the end sections (for example 149.2 mm and 184.2 mm respectively) and an internal diameter which is substantially larger than the end sections (for example 101.7 and 111.1 mm respectively). In this manner, the inertia (or quadratic moment) of the end sections 6, 7 with respect to the axis 1*a* may be much higher than that of the central section 8. Producing the great length central section 8 separately from the short end sections 6, 7 means that the amount of waste, in particular machining swarf, can be significantly reduced. This means that a considerably higher material return is obtained. The central section 8 may be in the form of a tube with a substantially constant bore and a substantially constant external diameter with an excess thickness at the ends near the sections 6 and 7 obtained by reducing the internal diameter in order to facilitate linking to said sections 6 and 7 by welding.

As can be seen in FIG. 1*b*, a tubular component 4 comprises a female end section 6, a male end section 7 and a central section 8. The end section 7 comprises a male threading 10 provided on an external surface which is substantially tapered, for example. The end section 7 also comprises a bore 11, an external surface 12, a shoulder 13, for example substantially radial, between the male threading and the external surface 12, and a terminal surface 14, for example substantially radial, between the bore 11 and the male threading 10 opposite to the shoulder 13. The bore 11 and the external surface 12 may be cylinders of revolution and be concentric.

The end section 7 is linked to the central section 8 via an internal surface 15 which is substantially tapered and an external substantially tapered surface 16. The bore 8*a* of the central section 8 in this case is a standard drill pipe with a diameter greater than the diameter of the bore 11. The external diameter of the central section 8 in this case is smaller than the diameter of the external surface 12 of the end section 7. The taper of the male threading 10 may be in the range 5° to 20°. The female end section 6 has a complementary structure with a female threading 110. The female threading 110 extends between a large diameter terminal surface 14 which is substantially radial in shape extending from the external surface 12 and a small diameter shoulder 13, which is substantially radial and extends from the bore 11. A cavity 21 extends principally axially from the terminal surface 14, in particular in the form of a hole which is a cylinder of revolution. The cavity 21 in this case is a hole opening to the inside of the tubular component 4 beyond the bore 11, in particular in the internal surface 15.

Figure 2:
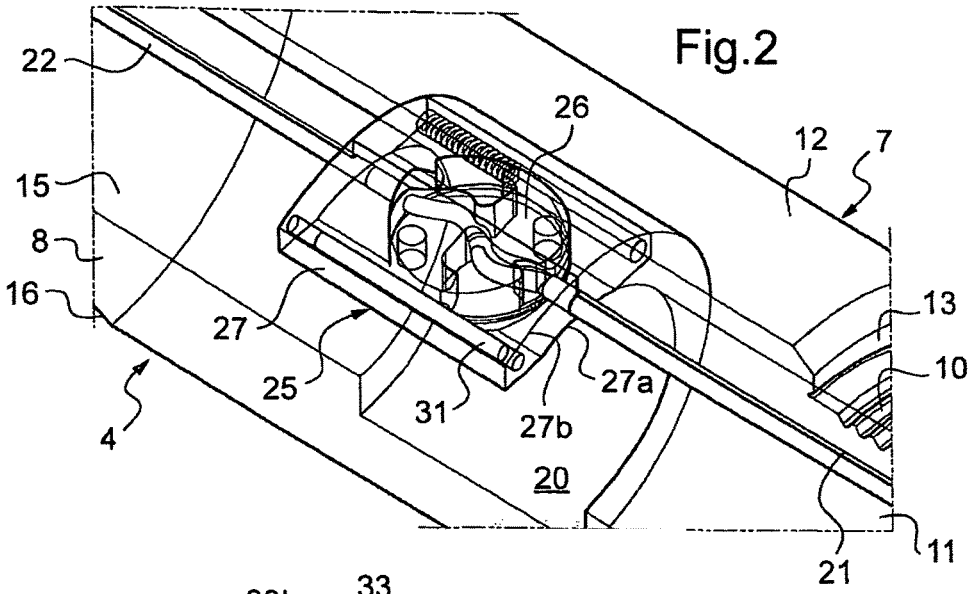

In general, the description below is given for the male section 7 of the component, but it also applies to the female section 6. As can be seen in FIG. 2, the male section 7 comprises a housing 20 which is generally annular in shape provided from the bore 11 at a distance from the tapered surfaces 15 and 16 on the one hand and from the threading 10 on the other hand. The housing 20 may have substantially radial sides and a base which is a cylinder of revolution. In other words, the housing 20 may be viewed as a zone of the bore 11, which is radially enlarged and axially limited.

A hole 21 substantially parallel to the axis of the tubular component 4 is formed in the male section 7. The hole 21 may extend axially from the free end of the male section 7 and open into the bore of the central portion 8 at the intersection with the substantially tapered internal surface 15. The hole 21 intersects the housing 20. The hole 21 in this case is a cylinder of revolution.

The tubular component 4 comprises a communications tube 22 disposed in the hole 21 and configured to project into the central portion 8 at the opening of said hole 21. The communications tube 22 may comprise a tubular shielding wall 23 in which a communications cable 24 is disposed; see FIG. 3. The communications tube may act as a housing for at least one data cable and/or electrical energy transport cable, said cable thus being protected against abrasion by the drilling mud. The tubular wall 23 is produced from a material having an elasticity which at least equals that of the tubular component 4 as a whole while being capable of plastic deformation. The material of the tubular wall 23 may be steel, in particular stainless steel, for example a nickel-based alloy such as those marketed under the trade mark Inconel®.

The tubular component 4 comprises a tensioner 25 for the communications tube 22. The tensioner 25 is disposed in the housing 20. The housing 20 is annular in this case. In FIG. 1*b*, the housing 20 is provided in the end section 6. In FIG. 3, the housing 20 is provided in the end section 7. Within the same tubular component 4, it is possible to have a single tensioner to place the communications tube under tension; in this case, the tensioner is located at one of the ends 6 or 7. Alternatively, the same tubular component 4 may have two tensioners, one at each of the ends 6 and 7.

The tensioner 25 interacts with the portion of the communications tube 22 passing through said housing 20. The tensioner 25 comprises a swivel 26 which is rotatably mounted in a mount 27 received in the housing 20 at right angles to a hole 21.

The mount 27 occupies a relatively small angular sector of the housing 20 in the embodiment shown in FIG. 2, for example less than 90°. The mount 27 may be held in position in the housing 20 by the communications tube 22. The mount 27 may be produced as a steel or light alloy part. The mount 27 comprises two transverse surfaces which can come into contact with the sides of the housing 20, two surfaces defining its width, a convex surface 27*b* matching the shape of the base of the housing 20 and a concave surface 27*a* substantially aligned with the bore 11.

In other words, the mount 27 may have the general external shape of a parallelepiped with two concentric faces about the geometrical axis of the tubular component 4. The mount 27 comprises an aperture 28 provided in an axis perpendicular to the axis 1*a* from the concave surface 27*a*. The aperture 28 may be blind. The aperture 28 intersects with two holes 29 and 30 parallel to the geometrical axis 1*a*. The longitudinal holes 29 and 30 are provided in the mount 27. The holes 29 and 30 are disposed either side of a radial hole 28 and partially intersect. In the hole 29, a rod which is a cylinder of revolution 31 is provided and projecting slightly into the radial hole 28. The rod 31 may be solid. The rod 31 may be force fitted. The hole 29 in this case is a through hole. The second hole 30 is blind. A rotation limiting mechanism 33 is mounted in the blind hole 30 and is provided with a finger 33*a* which is acted on by a spring 33*b* disposed between said finger 33*a* and the base of the blind hole 30. The shape of the finger 33*a* matches that of the blind hole 30 and can slide therein. The finger 33*a* may thus come to project partially into the radial hole 28. A hole 32 parallel to the axis of the tubular component 4 is provided to allow the communications tube 22 to pass through. The axis of the hole 32 can cross the axis of the swivel 26. The hole 32 is a through hole.

The swivel 26 is in the form of a disc formed as a generally cylindrical form of revolution and with a diameter substantially greater than its height measured along its axis of rotation, for example by more than twice. Said axis of rotation is substantially perpendicular to the axis 1*a*.

The end surfaces 26*a*, 26*b*, FIG. 5, of the swivel 26 are radial with respect to the axis of rotation of said swivel 26. The end surfaces 26*a*, 26*b* are disposed in a plane parallel to the axis 1*a*. Over a portion of its external circumferential surface 26*c*, the swivel 26 is provided with a groove 34 which is partially toroidal in shape. The shape of the groove 34 matches that of the projection formed by the rod 31. Contact of the rod 31 with the groove 34 ensures that the swivel 26 is held in position in the housing 28. All possible displacement of the swivel in translation along the axis of rotation is prevented. Further, the groove 34 may comprises a region 34*a* with an increased depth over a portion of the periphery. The increased depth region 34*a* allows the finger 33*a* to be displaced under the action of the spring 33*b* when the increased depth region 34*a* is aligned with the blind hole 30. Outside the increased depth region 34*a*, the blind hole 30 is partially obscured by the swivel 26. Once the rotation limiting mechanism 33 is triggered by alignment of the increased depth region 34*a* and the blind hole 30, the swivel 26 is locked in rotation. The sides of the increased depth region 34*a* form a contact abutment with the finger 33*a*. The swivel 26 is locked in rotation when in service. If required, it can be unlocked by acting on the finger 33*a* to retract it using a rod passed into the blind hole 30 to rotate the swivel towards the insertion position while keeping the finger 33*a* out of contact with the swivel 26. In the clockwise direction, an abutment comes into locking contact with the finger 33*a* projecting into the housing 28 and exerts an essentially radial force on the finger 33*a* which tends to push the finger 33*a* against the wall of the blind hole 30 and thus lock the finger 33*a* in position.

From the upper radial surface 26*a* of the swivel 26, two clear quarters or carved out zones 26*d*, 26*e* are dug out by hollowing out, for example by machining, over the major portion of the height of the swivel 26, leaving a disk close to the concave surface 27*a* of the mount 27. Each of these two quarters 26*d*, 26*e* occupies an overall angular sector of the order of 90° with an offset between them, leaving a portion of material 26*f* at the centre of the swivel 26. A straight hole 36 which is a cylinder of revolution connects these clear quarters 26*d*, 26*e* and means that the swivel 26 can let a straight tube pass through in translation, in particular the communications tube 22. Either side of the hole 36 and on the sides of the clear quarters there are two surfaces which form cams 37 and 38. The cams 37 and 38 are convex in shape in section in a radial plane of the swivel 26 and concave in shape in section in a plane parallel to the axis of rotation of the swivel 26 in the mount 27. The cams 37 and 38 are configured to come into contact simultaneously with the walls of the communications tube 22 during rotation of the swivel 26 clockwise from the insertion or sliding position towards the service position. In the service position, the communications tube 22 is locked with respect to the tensioner 25.

From the lower surface 26*b* of the swivel 34, means for driving said swivel 26 in rotation are provided which are accessible from the inside of the tubular component 4. In this case, the means for driving in rotation take the form of two recesses 39 and 40 which are diametrically opposed and parallel to the axis of rotation of the swivel 26.

The tensioner 25 may be pre-assembled with the swivel 26 disposed in the mount 27 and retained by the rod 31, see FIG. 5. The swivel 26 may be pre-orientated during assembly such that the hole 36 passing through its axis of rotation is orientated parallel to the holes 29 and 30 and aligned with the hole 32 of the mount 27 through which the communications tube 22 passes. The tensioner 25 is then brought into the housing 20 by hand by an operator or using a suitable tool. The holes 32 and 36 are aligned with the hole 21. Next, the communications tube 22 is threaded through the hole 21 then through the hole 32 of the mount 27 then through the hole 36 of the swivel 26.

Figure 3A:
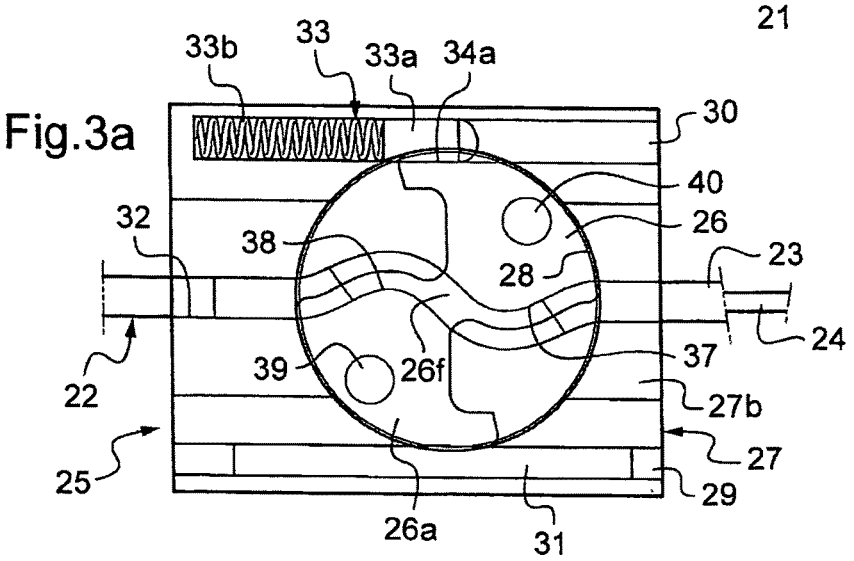
Figure 3B:
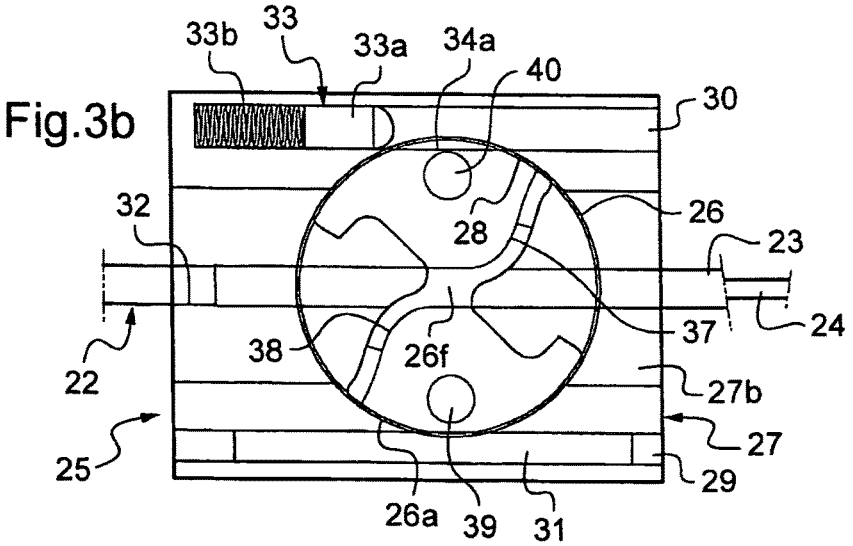

Once the communications tube 22 is in position in the tubular component 4 and fixed at both its ends, for example by enlarging and pressing its free ends against a surface of the tubular component 4, the swivel 26 is driven clockwise in rotation, for example through an angle of 30° to 45°, using a tool which engages in the recesses 39 and 40, forming bearing surfaces, causing progressive, deformation of the communications tube 22 until the appearance illustrated in FIG. 3*a* is achieved. The cams 37 and 38 come into contact with the communications tube 22 and cause said plastic deformation. This results in shortening of the portion of the communications tube 22 extending in the tube in the central section 8 and as a result places said communications tube 22 under tension.

Advantageously, the abutment which cooperates with the finger 33*a* is disposed such that the swivel 26 is in the abutment position when the central hole 36 is aligned with the corresponding hole 32 of the mount 27, which corresponds to the insertion position.

As can be seen in FIG. 6, the swivel 26 comprises two clear zones 26*d* and 26*e* which extend more widely than before, for example leaving two full thickness zones 26*g* and 26*h* which are generally in the shape of a bean, with a convex surface over an angular sector of the order of 240° to 300° of their circumference and a concave surface over the remainder of the angular sector. The full thickness zones 26*g* and 26*h* are distinct, being separated by the central passage 36 for the communications tube 22. The cams 37 and 38 are respectively formed on the sides of the full thickness zones 26*g* and 26*h* and correspond to the convex portion and to part of the concave portion in the zone included between the convex portion and the central passage 36. The junction between the convex portion and the concave portion is obtained by a tangential linkage substantially mid-way between the centre of the swivel 26 and its periphery. The other junction between the convex portion and the concave portion is close to the periphery of the swivel and is produced by means of a small radius linkage.

Further, the mount 27 comprises two sectors 42 and 43 projecting into the housing 28 radially inwardly from the side of said housing 28. In FIG. 6, the mount 27 comprises mechanical retention means, not shown, for the swivel 26, which is rotatably mounted about the axis of the cylinder defining the radial hole 28 in which the mount 27 is housed. The projecting sectors 42 and 43 are substantially symmetrical with respect to a plane passing through the axis of the swivel 26 or are at least diametrically opposed. The projecting sectors 42 and 43 are disposed axially above a lower circular portion of the swivel 26 and substantially at the same level as the full thickness zones 26*g* and 26*h*. The projecting sectors 42 and 43 are defined by upstream surfaces 42*a*, 43*a* and downstream surfaces 42*b*, 43*b* in the direction of rotation of the swivel 26 between the insertion position for a communications tube 22 to the final service position represented in FIG. 6. In this case, the direction of rotation is clockwise.

The shapes of the upstream surfaces 42*a* and 43*a* match that of the cams 37 and 38, allowing for the thickness of the communications tube 22. In other words, the upstream surfaces 42*a*, 43*a* are slightly concave close to the periphery of the swivel 26 and slightly convex on the opposite side. The shapes of the downstream surfaces 42*b*, 43*b* match those of the corresponding surfaces of the full thickness bean-shaped zones 26*g*, 26*h*, on the side opposite to the cams 37, 38. In this case, the downstream surfaces 42*b*, 43*b* are slightly concave and thus match the convex surfaces of the full thickness zones 26*g*, 26*h* in the insertion position of the swivel 26.

The downstream surfaces 42*b*, 43*b* may be substantially parallel to the axis of the swivel 26 in section in a plane parallel to said swivel axis 26. In section, in a plane parallel to the axis of the swivel 26, the upstream surfaces 42*a*, 42*b* have a shape that is adapted to the communications tube 22, in particular a concave circular arc. After inserting the communications tube 22 in the central passage 36 and close to the ends of the upstream surfaces 42*a*, 43*a* of the projecting sectors 42, 43, the swivel 26 is turned through an angle which may be up to 90°, or it may even slightly exceed it because of a slight resilience of the tube 22 following plastic deformation. The cams 37 and 38 then come into contact with the communications tube 22 and gradually deform it. The communications tube 22 also comes into contact with the upstream surfaces 42*a*, 43*a* so that it is finally deformed in a substantially symmetrical manner with respect to a radial plane of the tubular drilling component with a central portion substantially perpendicular to the axis 1*a* from which two portions with opposite concavities extend over an angular sector of the order of 120° to 150° followed by another portion with an opposite concavity over a complementary angular sector of the order of 60° to 30°.

In the fixed position illustrated in FIG. 6, the relative positions of the cams 37, 38 and the upstream surfaces 42*a*, 43*a* may be configured to be disposed at a constant distance corresponding to the dimensions of the communications tube 22. However, rotation of the swivel 26 causing deformation of the communications tube 22, in particular by elongation of said communications tube 22, may cause a slight reduction in the diameter of said communications tube 22. Thus, the distance from the passage remaining between the cams 37, 38 and the upstream surfaces 42*a*, 43*a* may be slightly reduced to take retraction of the communications tube 22 into account. Such a configuration means that more tightening can be obtained between the cam surface 37 and the upstream surface 42*a*, as well as between the cam surface 38 and the upstream surface 43*a*.

After rotating the swivel 26, the communications tube takes a serpentine form with three changes of curvature. The communications tube 22 is locked particularly securely between the cam surfaces 37, 38 forming shoes on the one hand and with the upstream surfaces 42*a*, 43*a* forming counterparts on the other hand. Any displacement of the communications tube, apart from overcoming frictional forces, would require said communications tube 22 to be plastically deformed, which would require far more energy.

In the embodiment illustrated in FIG. 7, after deformation, the communications tubes are given two changes in curvature. The swivel 26 comprises a cam 37 formed on the side of a relief zone 26*g* having the overall shape of a bell when viewed from above. Viewed from above, the cam 37 is in the shape of a kind of isosceles triangle with the two symmetrical sides having an outwardly concave profile, with the base having an outwardly convex profile, and the apex of the two identical sides being very substantially rounded. This apex is intended to come into bearing contact with the communications tube 22 when moving into the service position. The cam surface 37 brought into contact with the communications tube in the service position is formed on the upper surface of the bell.

The projecting surfaces 42 and 43 of the mount 27 match the shape of the relief zone 26*g*. The projecting sectors 42, 43 are disposed on the same side of the communications tube 22 in the insertion position prior to deformation, illustrated in FIG. 7. Each surface 42*a*, 43*a* forming an anvil comprises a convex zone extending close to the communications tube. The convex zone 42*a* extends over an angular sector of the order of 30° to 90°. The convex zone 42*a* is followed by a concave zone connecting tangentially to the convex zone 43*a* of the other surface at a distance from the communications tube 22 in the non-deformed state.

In order to shape the communications tube 22 after it is inserted in the hole 21, the swivel 26 is displaced by rotation through an angle of the order of 30° to 60°, bringing the cam 37 close to the surfaces 42*a*, 43*a* forming an anvil. In the variation of FIG. 7, the swivel 26 is movable in rotation not about its geometrical axis, as is the case with FIGS. 2 to 6, but about an axis of rotation 44 which is offset parallel to its geometrical axis and located in the proximity of the periphery of the housing 28. The swivel 26 is connected via a staple (not shown) comprising a pin which, for example, is screwed into the projecting sector 43 in order to constitute the axis of rotation 44. A mechanism limiting rotation of the swivel 26 is advantageously provided in order to fix it in the expected service position. As an example, a finger such as 33*a* may be provided in order to cooperate with the bell-shaped swivel.

In the embodiment illustrated in FIG. 8, the shapes of the projecting sectors 42, 43 are analogous to those of FIG. 7, with the exception that the projecting sector 42 is slightly truncated in the vicinity of the projecting sector 43 by a hollow 45 in place of the tangentially connecting concave zone as provided in FIG. 7. A surface 42*c*, which is substantially radial, is connected to the anvil surface 42*a* via a small radius rounding. The base of the hollow 45 is formed by the side of the housing 28. The hollow 45 may occupy an angular sector of the order of 5° to 15°. This configuration means that a degree of deformation of the communications tube 22 can be obtained which is greater than that obtained with a swivel such as that shown in FIGS. 2 to 6 as there is more space.

The swivel 26 comprises a relief zone 26*g* with a cam 37 having the shape of a bell analogous to the embodiment of FIG. 7. An aperture 46 which is oblong in shape is provided in the relief zone 26*g* at a small distance from the cam surface 37 intended to come into contact with the communications tube. A finger 47 which is substantially perpendicular to the longitudinal axis of the aperture 46 is disposed in it and supports a follower 48 passing through an opening extending radially at least from the aperture 46 to the cam 37. The follower 48 also passes over the communications tube 22. A corresponding follower, not visible in FIG. 8, passes below the tube 22 and is also articulated on the finger 47. At their ends opposite to the finger 47, the followers 48 are connected by an axis 49 on which a locking part 50 is also mounted, provided with a cam 38 facing the cam 37 from the other side of the communications tube 22. The finger 47, the followers 48 and the axis 49 together form stays to articulate the locking part 50 on the swivel 26.

The locking part 50 comes into contact with the communications tube 22 at the start of the rotational movement of the swivel 26 about the rotational axis 44. This locking part 50 can be used to increase the interference fit of the communications tube 22, preventing initial sliding. The locking part 50 prevents axial displacement of the portion of the communications tube 22 located on the side of the axis of rotation 44.

In other words, deformation of the tube 22 produces a slight displacement in the direction of the arrow 51 from its end located on the side of said arrow 51. The locking effect thus prevents excessive displacement of the communications tube between the tensioner 25 and the end of the tube 22 closest to the tensioner 25.

In the embodiment illustrated in FIG. 9, the thick zone 26*g* of the swivel 26 comprises a cam 37 facing an anvil surface 42*a* of a projecting sector 42 to deform the communications tube 22 and produce two changes of curvature. In order to hold the swivel 26 in place after rotation thereof about its axis of rotation 44, two holes are provided parallel to said axis of rotation or slightly inclined by an angle of the order of 5° to 20°. One, 52, is in the projecting sector 42 close to the communications tube 22 and the other, 53, is in the thick zone 26*g* close to the communications tube 22 after rotation of the swivel 26. A clip 54, visible in FIG. 10, which is generally C-shaped, for example produced from a steel wire, is inserted into the holes 52 and 53. The clip 54 acts as a mechanism limiting rotation of the swivel. Advantageously, it is positioned to block rotation of the swivel 26 after reaching the service position. This increases the security of the lock on the tube 22.

As can be seen in FIG. 10, the cam 37 and the anvil surface 42*a* may extend over only a portion of the thickness of the thick zone 26*g* and the corresponding projecting sector 42, leaving the surfaces 26*i* and 26*j* on the one hand and 42*i* and 42*j* on the other hand parallel to the axis of rotation 44 and axially distant along the axis of the swivel 26.

In the embodiments described above, the tensioner is integrally disposed in the thickness of the wall of the section 7 while being accessible from the inside of said section 7; in other words, the tensioner 25 may be maneuvered by passing a tool through the bore 11. This has the advantage of retaining the natural seal of the section 7.

In the embodiments illustrated in FIGS. 11 to 15, the tensioner 25 opens onto the external surface of the section 7, thereby offering direct access by a tool to change the communications tube 22 from the insertion position to the service position.

Figure 11:
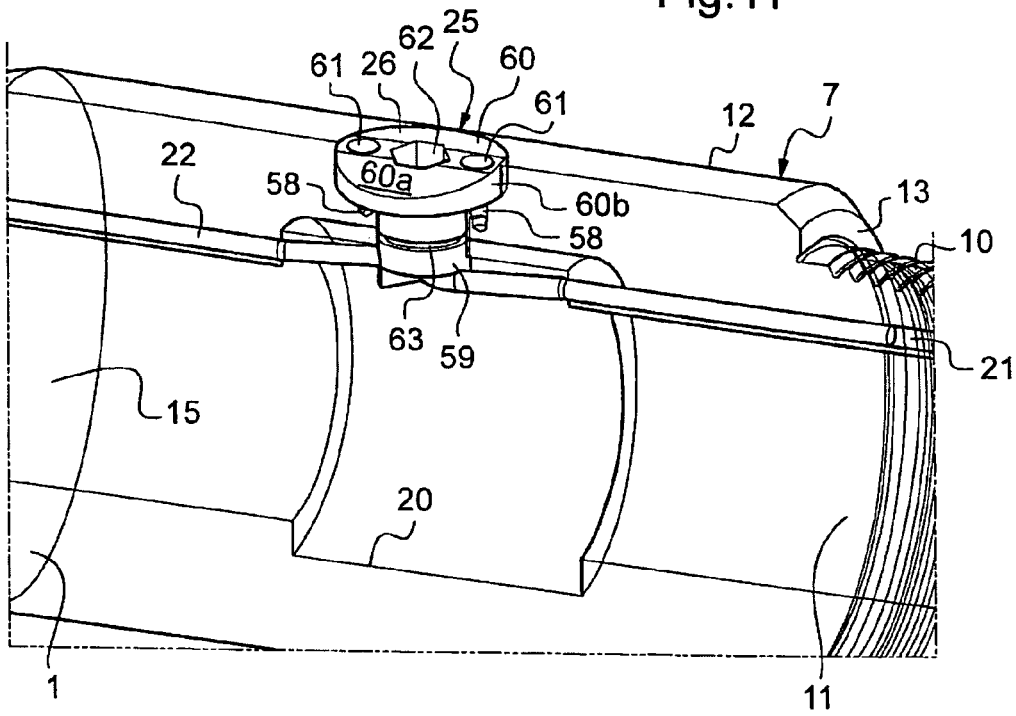
FIG. 11 is an exploded perspective view of an end section of a tubular component in accordance with another embodiment.
Figure 12:
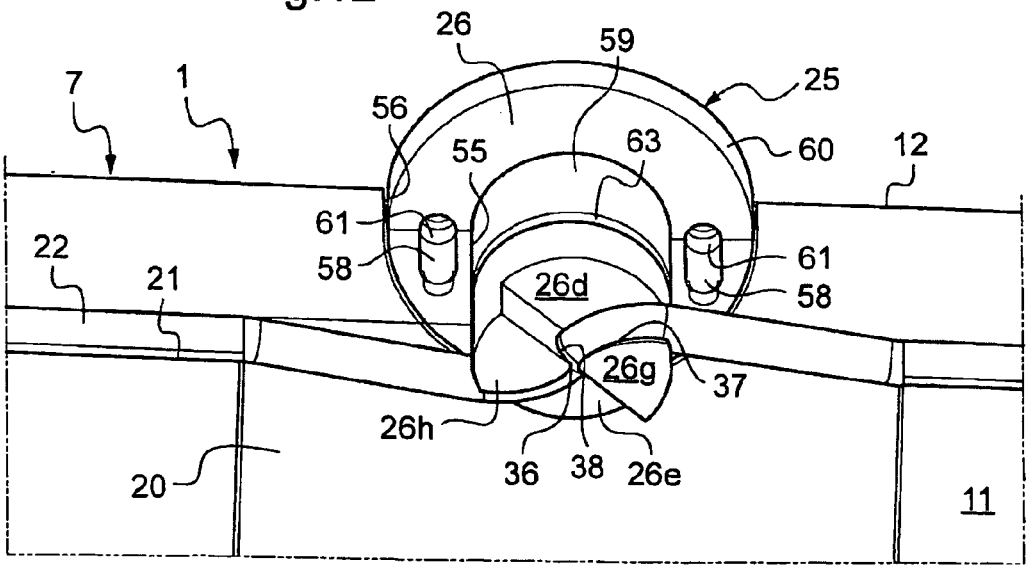
FIG. 12 is a perspective view of the tensioner of FIG. 11 in more detail.

In the embodiment illustrated in FIGS. 11 and 12, the section 7 is analogous to that of the embodiments above with the exception that a radial hole 55 passes through the wall of the section 7, opening into the housing 20 on the one hand and on the other hand onto the external surface 12 of the section 7. The through hole 55 comprises an enlarged portion 56 close to the external surface 12. At least one, for example two, threaded holes 58, preferably blind, are provided parallel to the through hole 55 from the shoulder separating the principal portion of the through hole 55 from the enlarged portion 56.

The tensioner 25 comprises a swivel 26 mounted in the through hole 55, preferably directly mounted. In other words, the presence of a mount is optional. The swivel 26 has a body of revolution 59 which is partially disposed in the through hole 55 and projects partially into the housing 20, and a head 60 disposed in the enlarged portion 56 with an end surface 60*a* flush with the external surface 12 of the section 7. The head 60 also comprises an axial surface 60*b*, in the axis of said swivel 26, with a shape that matches the enlarged portion 56. Two through holes 61 parallel to the axis of the swivel 26 are provided in the head 60 and open perpendicular to the shoulder separating the enlarged portion 56 from the principal portion of the through hole 55 while also possibly being aligned with the threaded holes 58. Thus, rotation of the swivel 26 may be locked by disposing one or two screws in the holes 61 and 58. The swivel 26 also comprises a blind central hole 62 provided from the end surface 60*a*. The central hole 62 is splined, for example cylindrical with multiple flats in order to be able to drive the swivel 26 in rotation by means of a suitable tool such as a hex key.

An annular groove 63 is provided in the body 59 of the swivel 26, substantially at the level of the wall of the section 7 in order to accommodate a seal, not shown, held in position by said groove 63 and in sealing contact with the principal portion of the through hole 55.

The lower end 26*b* of the swivel 26 has a shape close to that of the embodiment of FIGS. 2 to 5 with full thickness zones 26*g* and 26*h* occupying angular sectors of slightly less than 90°. Each full thickness zone 26*g*, 26*h* comprises an external surface flush with the principal portion 59 of the swivel 26, a radial surface and a convex surface forming a cam, respectively 37, 38. The cams 37 and 38 have a concave shape matching the shape of the communications tube 22 in section in a plane parallel to the axis of the swivel. The full thickness zones 26*g* and 26*h* are distinct, being separated by the central passage 36 for the communications tube 22.

The communications tube 22 is threaded through the hole 21, through the housing 20 and through the central passage 36 in the insertion position of the swivel 26, the swivel 26 being positioned in its housing formed by the through hole 55, the central passage 36 being aligned with the hole 21. Next, once the communications tube 22 is in position, the swivel 26 is turned using a key inserted in the central hole 62. Once the swivel 26 is in the locking or service position, after rotation through about 45° to 90°, one or two screws, not shown, are disposed in the holes 61 and screwed into the threaded holes 58.

The embodiment illustrated in FIGS. 13 to 15 is similar to the preceding embodiment with the exception that the lower portion of the swivel 26 comprises a single full thickness zone 26*g* with a generally half-moon shape offering a cam surface 37 to deform the communications tube 22. The cam surface 37 may be axially straight, i.e. tangential to a plane parallel to the axis of the swivel 26. Further, the communications tube 22 is in contact with a roller 65 of the type having a groove 65*a* with a profile adapted to the communications tube 22. The groove 65*a* may include a part-toroidal profile. The roller is mounted on an axle 66 which is tightly push-fitted into a hole, which may be a blind or through hole, provided in the thickness of the section 7. The roller 65 is disposed on the side of the swivel 26 opposite to the threading 10 to encourage displacement of the portion of the communications tube 22 located on said opposite side during deformation of said communications tube 22 by the cam 37 of the swivel 26.

Alternatively, the hole 21 from which the communications tube opens may be slightly flared close to the housing 20 on the side opposite the threading 10 in order to form a zone to allow deflection of the communications tube 22 relative to the axis 1*a*.

In the embodiments described below, the tensioner is essentially displaced with respect to an axis parallel with or identical with the axis 1*a*.

In the embodiment illustrated in FIGS. 16, 17*a* and 17*b*, the tensioner 25 comprises two jaws 70 and 71 which are displaced in rotation to deform the communications tube 22 by means of a tightening member 72. The jaws 70 and 71 and the tightening member 72 are disposed in the housing 20 which is annular in shape provided in the thickness of the wall of the section 7. The housing 20 is similar to that of the preceding embodiments. Further, a supplemental hole 73 diametrically opposite to the hole 21 is provided in an axis substantially parallel to the axis 1*a*, in particular from the substantially radial surface of the free end of the tubular component beyond the threading 10 and opening into the housing 20.

The jaws 70 and 71 may be identical or complementary in shape. The jaws 70 and 71 are provided so that they can be displaced in the housing 20 between an insertion position and a service position, also termed the locking position, of the communications tube 22. Displacement of the jaws 70 and 71 occurs substantially about the axis 1*a*. The jaws 70 and 71 are defined axially by substantially radial surfaces which if appropriate may be in contact with one of the shoulders defining the housing 20, and radially by surfaces of revolution with shapes matching the base of the housing 20 for the external surface and flush with the bore 11 for the internal surface of said jaws 70 and 71. In the proximity of the communications tube 22, the jaws 70 and 71 are defined by respective cams 37 and 38. The cams 37 and 38 advantageously have a concave shape viewed in section in a radial plane with one or two undulations with respect to the axis of the hole 21. Radially to either side of the cams 37 and 38, the jaws 70 and 71 have respective surfaces 74 and 75, following the same undulation. The surfaces 74 and 75 are straight in section in a radial plane. The surfaces 74 and 75 have a complementary shape. The cams 37 and 38 have a complementary shape apart from the communications tube 22. The cams 37 and 38 form a hollow footprint for the communications tube 22.

On the diametrically opposite side, the jaws 70 and 71 comprise respective bearing surfaces 76 and 77. The bearing surfaces 76 and 77 may have the shape of a circumflex accent, in section in a plane parallel to the axis 1*a* not passing through the bore 11, with two portions joining at an apex. The apexes of the bearing surfaces 76 and 77 form the mutually closest zone of said surfaces 76 and 77.

The tightening member 72 comprises two slides 78 and 79 connected by a screw 80. The screw 80 is mounted in alignment with the hole 73 and substantially parallel to the axis 1*a*. Each slide 78, 79 is defined by a large radial surface, a small radial surface, an external circumferential surface, an internal circumferential surface and lateral surfaces complementary to the bearing surfaces 76 and 77. The slides 78 and 79 are mounted either side of the apexes facing the bearing surfaces 76 and 77. The circumferential surfaces of the slides are flush with the corresponding circumferential surfaces of the jaws 70 and 71. The small radial surfaces of the slides 78 and 79 are mounted on the side of the apexes facing the bearing surfaces 76 and 77 and thus face each other. The screw 80 is mounted in through holes of said slides 78 and 79 with a head 80*a* bearing against the slide 79. The hole passing through the slide 79 may be smooth, while the hole passing through the slide 78 may be threaded such that tightening the screw 80 causes the slides 78 and 79 to come together axially, if appropriate with contact between their small radial surfaces in the service position of the communications tube 22.

The axial approach of the slides 78 and 79 forces out the bearing surfaces 76 and 77, separating them circumferentially, giving rise to a corresponding tightening of the cams 37 and 38 at the opposite end of the jaws 70 and 71, in particular by contact between the external circumferential surfaces of the jaws 70 and 71 and the bottom of the housing 20. The head 80*a* of the screw 80 may be of the socket multi-flat type. The screw 80 may be actuated by a suitable tool, for example a rod provided with a male end having flats placed in the hole 73 until it engages in the head 80*a*.

In the embodiment illustrated in FIGS. 18 to 20, the section 7 has an annular housing 20 and a supplemental hole 73 similar to the preceding embodiment, except that the hole 73 is formed a short distance from the hole 21. The tensioner 25 comprises a mount 27 mounted in the housing 20. The mount 27 occupies an angular sector of the order of 20° to 60°. The mount 27 is in the form of a frame with two longitudinal elements and two lateral or circumferential elements occupying the depth of the housing 20. The mount 27 is preferably produced as a single part. Substantially at its centre, the mount 27 has a space 82 in which a circumferentially movable jaw 70 is disposed so as to cooperate with a fixed jaw 71 which is formed as a single piece with the mount 27 and constitutes one of its longitudinal elements. The jaws 70 and 71 have cams 37 and 38 as well as radially neighbouring surfaces of the cams which are similar to those in the preceding embodiment. The mount 27 also has a hole 32 forming a passage for the communications tube 22, aligned with the hole 21 and formed in the lateral elements of the mount 27.

The jaw 70 is pivotably mounted in the mount 27 by means of a rounded end 83 with a shape matching that of a female rounded zone 84 of the mount 27 allowing the jaw 70 to pivot with respect to the mount 27 about a substantially radial axis disposed in the proximity of one of its longitudinal ends, giving rise to the essentially circumferential displacement of the movable jaw 70. On the side opposite to the cam 37, the movable jaw 70 comprises a sliding surface 76 inclined by approximately 5° to 20° with respect to a plane passing through the axis 1*a*. Said inclination is about a radial axis.

The tensioner 25 also comprises a slide 78 mounted for translation on a screw 80 parallel to the axis 1*a* and provided with a head 80*a* to actuate it in rotation using an elongate tool passed through the hole 73. The head 80*a* bears against a radial annular surface of the mount 27 forming a shoulder. The screw 80 projects into facing holes provided in the lateral elements of the mount 27. Thus, the screw 80 can turn with respect to the mount 27 while being held in respect of translation in at least one direction. The slide 78 may be provided with a threaded hole through which said screw 80 passes so that driving the screw 80 in rotation in one direction causes displacement of the slide 78 from the insertion position illustrated in FIG. 20 to the service position illustrated in FIG. 19, the slide 78 approaching the head 80*a* of the screw 80. The slide 78 is locked in rotation by interference with a surface formed by the internal side of the space 82, in other words by a surface of the longitudinal element of the mount 27 opposite to the fixed jaw 71 in contact with an anti-rotation surface 78*a* of the slide 78. Further, on the side opposite to its anti-rotation surface 78*a*, the slide 78 has a sliding surface 78*b* with a slightly concave shape in contact with the corresponding surface 76 of the movable jaw 70.

In the insertion position of FIG. 20, the slide 78 is located at the end of the screw 80 opposite to the head 80*a*. The movable jaw 70 is separated from the fixed jaw 71, leaving a rectilinear passage for insertion of the communications tube 22 through the mount 27. Next, the screw 80 is turned, for example in the clockwise direction, which causes translational displacement of the slide 78 towards the head 80*a*. The slide 78 bears via its anti-rotation surface 78*a* on the corresponding surface of the mount 27 on the one hand and on the other hand, the sliding surface 78*b* bears on the corresponding surface 76 of the jaw 70. The surface 76 of the movable jaw 70 is inclined with respect to the axis of the screw 80, and so the longitudinal translational displacement of the slide 78 forces the movable jaw 70 to be displaced and to pivot about the rounded end 83. The jaws 70 and 71 move together, causing plastic deformation of the communications tube 22 into the service position of FIG. 19.

In the embodiment illustrated in FIG. 21, the tensioner comprises a movable jaw 70 with a generally circumferential displacement in the housing 20. The movable jaw 70 is provided with a projecting cam 37 intended to come into contact with the communications tube 22 and deform it plastically during displacement of the movable jaw 70. The movable jaw 70 has a generally rectangular parallelepipedal shape, one of the sides of said parallelepiped having a convex surface forming the cam 37. The tensioner 25 also comprises two rods 85 disposed parallel to the axis 1*a*. The rods 85 are substantially aligned. The rods 85 can be displaced in translation, separating from each other thereby to project into the blind holes 86 provided in the wall of the housing 20, said blind holes 86 having a flared shape with a tapered side 87. The rods 85 comprise a bevelled surface 130, forming an angle of 5° to 15°. This bevelled surface comes into sliding contact against the tapered side 87 via an edge 131 of said bevelled surface 130. The rods 85 have a longitudinal position in translation controlled by a wheel 88 mounted for rotation about an axis 89, for example radial, and provided with an external surface with a variable diameter, for example in the form of two spirals giving rise to an increase in diameter during rotation of the wheel 88 facing the rods 85. In other words, the rods 85 are substantially retracted in the position for mounting the tensioner 25 and in particular the wheel 88. Next, rotation of the wheel 88 causes the rods to deploy axially and their translation perpendicular to their axial axis of deployment until they project into the holes 86, engage with the tapered surfaces 87 and as a result cause lateral displacement of the tensioner 25 in translation. More generally, said lateral displacement of the tensioner 25 and thus of the cam surface 37 may be viewed as a circumferential movement in the housing 20 substantially about the axis 1*a*.

An anti-return mechanism for the wheel 88 may be provided in the form of a ratchet 90 of the flat leaf spring type provided to snap-fit behind a shoulder 91 of the wheel 88, thus holding said wheel 88 in the service position. Rotation of the wheel 88 may be controlled by inserting a tool provided with a drive head, for example a multi-flat head, into the bore 11 of the tubular component and engaging with said wheel 88 or with a shaft, not shown, attached to said wheel 88.

The embodiment illustrated in FIGS. 22 to 24 resembles that illustrated in FIGS. 18 to 20 with the exception that displacement of the movable jaw 70 is carried out by sliding with respect to the mount 27 under the effect of axial displacement of the slide 78. Displacement in translation of the movable jaw 70 may be carried out along an axis substantially perpendicular to the geometrical axis of the screw 80. Alternatively, the displacement of the slide 78 may be circumferential with respect to the axis 1*a*. The movable jaw 70 has a generally triangular shape viewed from above, see FIGS. 23 and 24, with the exception of the cam 37 forming a bulge on one side. The triangular shape may be of the right angled triangle type with the sliding surface 76 formed on the hypotenuse, the cam 37 projecting from the long side and the short side forming the sliding surface with respect to a shoulder 27*k* of the mount 27.

Alternatively, the short side of the movable jaw 70 may slide on a lateral surface defining the space 82. In the position illustrated in FIG. 23*a*, the movable jaw 70 is in a retracted position with respect to the communications tube 22; in other words, a substantially straight passage is left for the communications tube 22. The slide 78 is in a position corresponding to a longitudinal end of the space 82. Next, by rotation of the screw 80, for example in the clockwise direction, by passing a tool into the hole 73, the slide 78 is displaced from one end to the other of the space 82, approaching the head 80*a* of the screw 80 and hence the surface 76 of the movable jaw 70 slides with respect to the surface 78*b* of the slide 78, the movable jaw 70 being retained axially by the shoulder 27*k* of the mount 27. As can be seen in FIG. 23*b*, the movable jaw 70 is also retained in the mount 27 by a set of runners between two mutually facing faces of the movable jaw 70 and the slide 78. The movable jaw 70 is thus displaced in the direction of the communications tube 22 with which the cam 37 comes into contact. Next, the movable jaw 70 causes plastic deformation of the communications tube 22 until it comes into the position illustrated in FIG. 24, termed the service position.

In the embodiment illustrated in FIGS. 25 to 28, the tensioner 25 operates by snap-fitting. The section 7 of the tubular component 4 is similar to that of the preceding embodiment, with an annular housing 20 and a hole 73 parallel to the hole 21 housing the communications tube 22 and provided in the thickness of the wall of said section 7. The hole 73 extends from the two sides of the housing 20 and is blind on the side opposite to the threading 10. The tensioner 25 comprises a movable jaw 85 and an actuating eccentric 86. The actuating eccentric 86 may be in the form of a crank. The actuating eccentric 86 may comprise a solid metallic rod comprising a crankshaft 87 disposed in the housing 20, one end 88 disposed in the blind portion of the hole 73 and one actuating end 89 disposed on the opposite side and capable of being displaced by rotation about its axis by means of a rotational drive tool, for example a multi-flat key cooperating with a corresponding head. The ends 88 and 89 are cylinders of revolution and are substantially aligned. The crankshaft 87 comprises a central portion 87*a* parallel to the end portions 88 and 89 and two intermediate inwardly curved portions 87*b* and 87*c* obtained by plastic deformation after mounting a straight rod in the hole 73.

The movable jaw 85 has a shape adapted to the housing 20 with substantially radial surfaces at its longitudinal ends and rounded internal and external surfaces. On the communications tube 22 side, the movable jaw 85 comprises a cam surface 37 with a rounded concave shape matching the shape of the communications tube 22 and surfaces 74 disposed in a plane passing through the axis of the tubular component and joining the external and internal rounded surfaces. The movable jaw 85 also comprises a housing 90 for the eccentric 86, said housing 90 being open onto the external surface of the movable jaw 85 to allow the central portion 87*a* to pass through during assembly. The housing 90 extends generally in the shape of a capital L from the opening on the external surface so that assembly of the central portion 87*a* of the eccentric 86 is carried out firstly by a relative radial movement with respect to the movable jaw 85 then by a circumferential movement in the direction of the communications tube 22. The central portion 87*a* then comes into abutment against a bearing surface 91 of said movable jaw 85 formed at the base of the housing. Rotation of the eccentric 86 in a direction approaching the central portion 87*a* of the communications tube 22 then causes said central portion 87*a* to bear on the bearing surface 91 and causes the movable jaw 85 to be displaced circumferentially in the housing 20, thus bringing about plastic deformation of the communications tube 22.

In a similar embodiment, illustrated in FIGS. 29 and 30, actuation of the movable jaw 85 is carried out by axial displacement of a rod 92 with a pointed end. The rod 92 is straight and disposed in the hole 73. The movable jaw 70 has a hole 93 which, in the insertion position, is misaligned with respect to the hole 73. The misalignment is less than the radii of the holes 73 and 93 so that insertion of the actuating rod 92 into the hole 93 is relatively easy because it is shaped with a pointed end. Continuing the axial displacement of the rod 92 causes translational displacement of the movable jaw 70 in the direction of the arrow 94. Another movable jaw 71 may be disposed on the opposite side so that, via a corresponding cam 38 with a corresponding shape to the cam 37, it can deform plastically and retain the communications tube 22. The movable jaw 71 may also be provided with a through hole 93 which is misaligned with respect to a supplemental hole 96 which is analogous to the hole 73 and into which another rod 92 will be inserted; pushing it axially into the hole 93 causes displacement of the movable jaw 71 in the direction indicated by the arrow 95 in the direction of the communications tube 22.

If necessary, the portions of the hole 21 in the vicinity of the housing 20 may be slightly flared to facilitate deformation of the communications tube 22 while avoiding pinching it.

In the embodiment illustrated in FIG. 31, the tubular component has been shown before mounting the tensioner. The actuating eccentric 86 formed in situ by plastic deformation is mounted on bearings 96, 97 disposed in the hole 73 either side of the housing 20. The bearings 96 and 97 reduce friction and facilitate pivoting of the eccentric 86.

FIG. 33 is a sectional view of a tensioner 25 with an eccentric, in the service position. The plane P defined by the axis of the central portion 87*a* of the eccentric in the service position and by the axis of the end portions 88 and 89 of said eccentric 86 pass radially outwardly with respect to the axis of the communications tube 22 in order to provide the movable jaw 85 with a stable position. Thus, during rotation of the eccentric, it passes through a point of maximum force then returns to a slightly more relaxed position. The forces are thus substantially lower than those necessary for plastic deformation of the communications tube.

The embodiment illustrated in FIG. 32 is a view of the tensioner 25 of FIG. 33, in which the tensioner is in an intermediate position between the insertion position and the service position. In this embodiment, during rotation of the eccentric 86, the movable jaw 85 is displaced not merely circumferentially with respect to the axis but also by pivoting about itself.

The invention claimed is:

1. A tubular component for a drill stem for drilling a hole, the component comprising:

a first end section comprising a first threading;

a second end section comprising a second threading;

a substantially tubular central section;

a hole provided in at least one of the first and second end sections; and a tensioner for a communications tube disposed in the hole, the tensioner operating by deformation of a regular section of the communications tube, the tensioner being disposed in a housing provided in at least the section, at a distance from the ends of the communications tube, the housing intersecting with the hole, wherein the communications tube is disposed at least in a central section and in the hole, communications tube comprising two ends and a regular section passing through the housing, and wherein the communications tube has at least two inversions of curvature over a portion with a length of less than 100 mm after deformation.

2. A component according to claim 1, wherein the communications tube has a radius of curvature of less than 100 mm in a service position, or less than 30 mm.

3. A component according to claim 1, wherein the hole is substantially parallel to a longitudinal axis of the component.

4. A tubular component for a drill stem for drilling a hole, the component comprising:

a first end section comprising a first threading;

a second end section comprising a second threading;

a substantially tubular central section;

a hole provided in at least one of the first and second end sections; and a tensioner for a communications tube disposed in the hole, the tensioner operating by deformation of a regular section of the communications tube, the tensioner being disposed in a housing provided in at least the section, at a distance from the ends of the communications tube, the housing intersection with the hole, wherein the tensioner comprises a swivel via which the communications tube passes, the swivel comprising at least one movable cam leaving a free passage for a communications tube in an insertion position and leaving an undulating passage for a communications tube in a service position of the swivel, the swivel comprising a bearing surface to bring about a change from the insertion position to the service position.

5. A component according to claim 4, wherein the tensioner comprises a mount fixed in the housing and receiving the swivel.

6. A component according to claim 4, wherein the swivel is received directly in the housing.

7. A component according to claim 4, wherein the tensioner comprises a mechanism limiting rotation of the swivel.

8. A component according to claim 7, wherein the limiting mechanism comprises a finger urged in translation by a spring, the finger and the spring being housed in a blind hole of the component, the finger interfering with the swivel, the finger projecting into a groove provided on a circumferential face of the swivel and being configured to interfere with an anti-return abutment when in the service position.

9. A component according to claim 7, wherein the limiting mechanism comprises a screw, a ratchet, or a clip.

10. A component according to claim 9, wherein the tightening member comprises a slide with an axial position which is controlled by a screw parallel to the axis of the component, the slide being mounted in translation between a bearing surface of the movable jaw and a reaction surface of the mount.

11. A component according to claim 4, further comprising a rod to maintain the swivel in translation, the rod being substantially parallel to the axis of the communications tube.

12. A component according o claim 4, further comprising a cam forming part of the swivel and a cam articulated with respect to the swivel by two stays.

13. A component according to claim 4, further comprising a cam to lock a position of the communications tube and a cam to deform the communications tube.

14. A tubular component for a drill stem for drilling a hole, the component comprising:

a first end section comprising a first threading;

a second end section comprising a second threading;

a substantially tubular central section;

a hole provided in at least one of the first and second end sections;

a tensioner for a communications tube disposed in the hole, the tensioner operating by deformation of a section of the communications tube the tensioner being disposed in a housing provided in at least the section, at a distance from the ends of the communications tube, the housing intersecting with the hole; and a roller to stop the communications tube from jamming, the roller comprising a grooved wheel in contact with the communications tube.

15. A tubular component for a drill stem for drilling a hole, the component comprising:

a first end section comprising a first threading;

a second end section comprising a second threading;

a substantially tubular central section;

a hole provided in at least one of the first and second end sections; and a tensioner for a communications tube disposed in the hole, the tensioner operating by deformation of a regular section of the communications tube, the tensioner being disposed in a housing provided in at least the section, at a distance from the ends of the communications tube, the housing intersecting with the hole, wherein the hole provided in at least one of the first and second ends has a flared surface to link with the housing.

16. A tubular component for a drill stem for drilling a hole, the component comprising:

a first end section comprising a first threading;

a second end section comprising a second threading;

a substantially tubular central section;

a hole provided in at least one of the first and second end sections; and a tensioner for a communications tube disposed in the hole, the tensioner operating by deformation of a regular section of the communications tube the tensioner being disposed in a housing provided in at least the section, at a distance from the ends of the communications tube, the housing intersecting with the hole, wherein the tensioner comprises at least one jaw through which the communications tube passes, the jaw comprising at least one cam leaving a free passage for a straight communications tube in an insertion position and. leaving an undulating passage for the communications tube in a service position of the jaw, at least one jaw comprising a bearing surface to force tightening of the jaw from the insertion position to the service position, the tensioner comprising a member for tightening the jaw.

17. A component according to claim 16, wherein the member for tightening the jaw can be actuated from a frontal surface of the end, the tightening member comprising a screw or a pointed rod housed in a hole provided in the thickness of the end section.

18. A component according to claim 16, wherein the jaw is disposed substantially concentrically with the component, the housing being annular.

19. A component according to claim 16, wherein the tightening member comprises two slides with an axial position controlled by a screw parallel to the axis of the component, the slides each comprising two sliding surfaces which are inclined with respect to the axis of the component, each sliding surface of a slide having an inclination opposite to the other sliding surface of the slide and with an inclination opposite to the corresponding sliding surface of the other slide and each jaw comprises bearing surfaces on the side opposite the communications tube in contact with the sliding surfaces of the slides, the bearing surfaces of one jaw joining at the middle of the jaw in the axial direction.

20. A component according to claim 16, wherein one jaw is fixed and the other is movable under action of the tightening member, the fixed jaw forming part of a mount disposed in the housing, the movable jaw being pivotably mounted with respect to the mount.

21. A component according to claim 16, wherein one jaw is fixed and the other is movable under action of the tightening member, the fixed jaw forming part of a mount disposed in the housing, the movable jaw being mounted in translation with respect to the mount and in contact with an axial abutment surface of the mount.

22. A component according to claim 16, wherein the jaw comprises a snap-fitting mechanism having a stable state in the service position, the jaw being housed in the housing in the service position and projecting with respect to the housing in the insertion position.

23. A component according to claim 22, wherein the jaw is articulated about an actuating eccentric, the jaw being fixed in the housing at least in translation.

24. A component according to claim 23, wherein the actuating eccentric of the snap-fitting mechanism comprises a crank.

25. A component according to claim 16, comprising two movable jaws, the tightening member comprising rods which can be actuated from a frontal surface of the component.

26. A component according to claim 16, wherein the tightening member comprises a crank interacting with a movable jaw, the crank being stable in the service position.

27. A method for tensioning a communications tube mounted in a tubular drill stem component, extending in at least a central section and in a hole provided in at east one end section of the component, the method comprising:

mounting a communications tube tensioner in a housing provided in at least one end section of the component, at a distance from the ends of the communications tube; and actuating the tensioner until plastic deformation of the communications tube is brought about, wherein a cam surface of the tensioner in contact with a portion of the communications tube is displaced in a circumferential direction with respect to the axis of the component.

* * * * *